US010553985B2

(12) United States Patent
Sorrentino et al.

(10) Patent No.: US 10,553,985 B2
(45) Date of Patent: Feb. 4, 2020

(54) TABLETOP ENCLOSURE INCLUDING A SPRING-LOADED DROP-DOWN FLIP-TOP COVER

(71) Applicant: Crestron Electronics, Inc., Rockleigh, NJ (US)

(72) Inventors: Gregory Sorrentino, Brewster, NY (US); Albert Pedoeem, West Orange, NJ (US); David Paolazzi, North Arlington, NJ (US)

(73) Assignee: Crestron Electronics, Inc., Rockleigh, NJ (US)

( * ) Notice: Subject to any disclaimer, the term of this patent is extended or adjusted under 35 U.S.C. 154(b) by 120 days.

(21) Appl. No.: 15/813,738

(22) Filed: Nov. 15, 2017

(65) Prior Publication Data

US 2019/0148874 A1 May 16, 2019

(51) Int. Cl.

| | |
|---|---|
| ***H01R 35/04*** | (2006.01) |
| ***H01R 13/447*** | (2006.01) |
| ***A47B 21/06*** | (2006.01) |
| ***H01R 13/52*** | (2006.01) |
| ***H01R 13/73*** | (2006.01) |
| ***H01R 25/00*** | (2006.01) |

(52) U.S. Cl.

CPC ..... *H01R 13/5213* (2013.01); *A47B 21/06* (2013.01); *H01R 13/73* (2013.01); *H01R 25/006* (2013.01); *A47B 2021/066* (2013.01)

(58) Field of Classification Search

CPC ..... A47B 21/06; H01R 35/04; H01R 23/25; H01R 31/06; H01R 13/447; H01R 13/5213; H01R 13/4534

USPC ..... 361/728, 616, 600; 439/136, 131, 535, 439/540.1, 652

See application file for complete search history.

(56) References Cited

U.S. PATENT DOCUMENTS

| | | | | |
|---|---|---|---|---|
| 5,575,668 | A * | 11/1996 | Timmerman | A47B 21/06 174/482 |
| 6,046,405 | A | 4/2000 | Obermann et al. | |
| 6,162,071 | A | 12/2000 | Muller | |
| 7,312,393 | B2 * | 12/2007 | McCarthy | A47B 21/06 174/480 |
| 7,667,145 | B2 | 2/2010 | Dinh et al. | |
| 8,943,978 | B2 | 2/2015 | Soper et al. | |
| 9,706,833 | B2 * | 7/2017 | Newhouse | A47B 21/06 |
| 2003/0070592 | A1 * | 4/2003 | Grasse | A47B 21/06 108/50.02 |
| 2008/0200050 | A1 * | 8/2008 | Byrne | H01R 35/04 439/131 |

(Continued)

*Primary Examiner* — Abdullah A Riyami
*Assistant Examiner* — Thang H Nguyen
(74) *Attorney, Agent, or Firm* — Crestron Electronics, Inc.

(57) ABSTRACT

A tabletop enclosure having a fully automatic self-actuated drop-down recessing flip-top cover. After the lid has automatically, spring open it begins to autonomously recess by sliding downwardly in a smooth controlled manner into the flip-top enclosure until it is substantially recessed. According to an embodiment, the enclosure includes modular rail guides designed to receive an interchangeable combination of single, dual, or triple, sized modules, each module having easy to use alignment module rails to ease module installation. Interchangeable modules are inserted from the top of the housing frame so that the tabletop enclosure can be configured for various connectivity scenarios.

18 Claims, 35 Drawing Sheets

(56) References Cited

U.S. PATENT DOCUMENTS

| | | | | |
|---|---|---|---|---|
| 2008/0244052 | A1* | 10/2008 | Bradicich | G06F 1/183 709/223 |
| 2009/0165679 | A1* | 7/2009 | Bakker | A47B 21/06 108/50.02 |
| 2010/0178797 | A1* | 7/2010 | Byrne | H05K 5/03 439/540.1 |
| 2010/0227498 | A1* | 9/2010 | Byrne | A47B 21/06 439/528 |
| 2011/0177714 | A1* | 7/2011 | Byrne | H02G 3/185 439/535 |
| 2012/0200989 | A1* | 8/2012 | Byrne | H01R 13/447 361/641 |
| 2014/0265753 | A1* | 9/2014 | Soper | A47B 21/06 312/22 |
| 2019/0045645 | A1* | 2/2019 | Holm Jensen | H05K 5/0217 |

* cited by examiner

TABLETOP ENCLOSURE INCLUDING A SPRING-LOADED DROP-DOWN FLIP-TOP COVER

BACKGROUND OF THE INVENTION

Technical Field

The present invention relates to a recessed surface enclosure. More particularly, the present invention relates to a recessed tabletop surface enclosure having modular connectivity modules.

Background Art

Most business and academic environments include one or more conference rooms. These conference rooms may be used for any number of functions, but are typically used for meetings in which participants are seated around a table to discuss matters of interest to the participants. Conference rooms are frequently used for presentations where a presenter, standing at one end of the table and using one or more visual aids, such as a video projector or video display screen mounted on the wall at the opposite end of the table, addresses a number of participants seated around the table. It is also common for participants seated at a conference room table to use the table's work surface to support or rest any electronic devices they have with them, for example, a mobile laptop computer. It is also common for one or more of the participants seated at a conference room table to present information from one of their electronic devices (e.g., a laptop) to one more available conference room visual aids using a cable.

Tabletop enclosures are commonly deployed within the context of a conference room to provide a data communication interface to users. Tabletop enclosures, for example, can provide an interface for presentation information sources such as laptops, tablet computers, smartphones, to connect with presentation aids installed within the room, for example, projection devices, graphical displays, and speakers.

Tabletop enclosures can be recessed and directly mounted into the work surface of a table so that its housing extends below the tabletop surface through a cutout portion of the tabletop surface. Some flip-top enclosures utilize a lid that, when closed, fold flush with the table surface it is mounted within. When not in use, a lid provides a one way to protect the interior connections and/or touch screens provided by a flip-top enclosure.

BRIEF SUMMARY OF THE INVENTION

The present disclosure provides a modular flip-top tabletop enclosure having a fully automatic, mechanically actuated, spring-loaded drop-down lid. The tabletop enclosure includes a self-actuated lid configured to spring open by pivoting up along its rear edge. After the lid has sprung open and is standing vertically upright (i.e. perpendicular to its closed position,) it begins to automatically recess, by sliding downwardly in a smooth controlled manner into the tabletop enclosure until it is substantially recessed. In an embodiment, the tabletop enclosure is configured with a sensor to determine if the lid is open. Any number of sensors may be used determine the lid position. This information may be transmitted to and used by a control processor or control system.

In a preferred embodiment, the flip-top enclosure includes opposable sets of module rail guides designed to receive an interchangeable combination of single, dual, or triple-gang sized modules, each module having easy to use alignment module rails to ease module installation. The provided module guides will only accept a module rail of a module insert that is aligned properly, thus ensuring the proper alignment of all modules inserted into the tabletop enclosure.

One or more Interchangeable modules can be inserted from the top of the housing frame, thereby allowing the tabletop enclosure to be configured for a various number of connectivity and/or power distribution scenarios. In some embodiments, the various module inserts may be configured to provide one or more of, USB charging, A/C power, D/C Power, LAN connection, OneTouch button control, low-voltage power distribution, retractor cable access, pass-through cable access, or the like. In an embodiment, the module inserts are secured into place by one or more module locking bars.

In an embodiment, the flip-top enclosure includes a DC-DC power and signal bus board with multiple bus board module connectors in each module bay. A module insert may include a connector that mates to a corresponding bus board module connector. The power and signal bus board can distribute power and data to any module insert requiring it. In an embodiment, the bus board provides 24-Volt DC power to module inserts and a communication bus for data communication with control system.

In an embodiment, a bezel is secured using a plurality of magnets disposed thereunder, which secure along top perimeter of the tabletop enclosure frame so that the surface of the bezel conceals the edges of an opening cut through a tabletop. The bezel may include a crossbar in order that module inserts may only be installed, removed, or changed when the bezel is removed from the flip-top tabletop enclosure frame.

In an embodiment, the enclosure houses a control system. The control system may be implemented as a combination of computing devices, such as a combination of a DSP and a microprocessor, a plurality of microprocessors, one or more microprocessors in conjunction with a DSP core, or any other such configuration. The control system may be any controller, microcontroller, or state machine. control system may be implemented with, a Digital Signal Processor (DSP), an Application Specific Integrated Circuit (ASIC), a Field Programmable Gate Array (FPGA) or other programmable logic device, discrete gate or transistor logic, discrete hardware component(s), or any combination thereof.

According to an embodiment, the enclosure includes geolocation beacons. In an embodiment, the enclosure includes backlighting for one or more buttons accessible to users In an embodiment, the enclosure frame is constructed from metal. According to an embodiment, the enclosure includes dog-ears recessed into the frame initially for ease of the frame installation into the tabletop so that when the frame is positioned properly into the table the dog ears will open into their locking position and as they are screw tightened from the top of the enclosure, they will engage the bottom of the table and lock down the frame. According to an embodiment, the enclosure includes two dog-ear fasteners on each of its sides.

According to an embodiment, one-touch and gravity activated retractors are installed into the cable retractor modules for access by the user. According to an embodiment, multiple cable retractors are mounted on any or all sides of the unit.

BRIEF DESCRIPTION OF THE SEVERAL VIEWS OF THE DRAWINGS

The present invention may be better understood, and its features made apparent to those skilled in the art by referencing the accompanying drawings.

The use of the same reference symbols in different drawings indicates similar or identical items.

REFERENCE SIGNS LISTING

Figure 1:
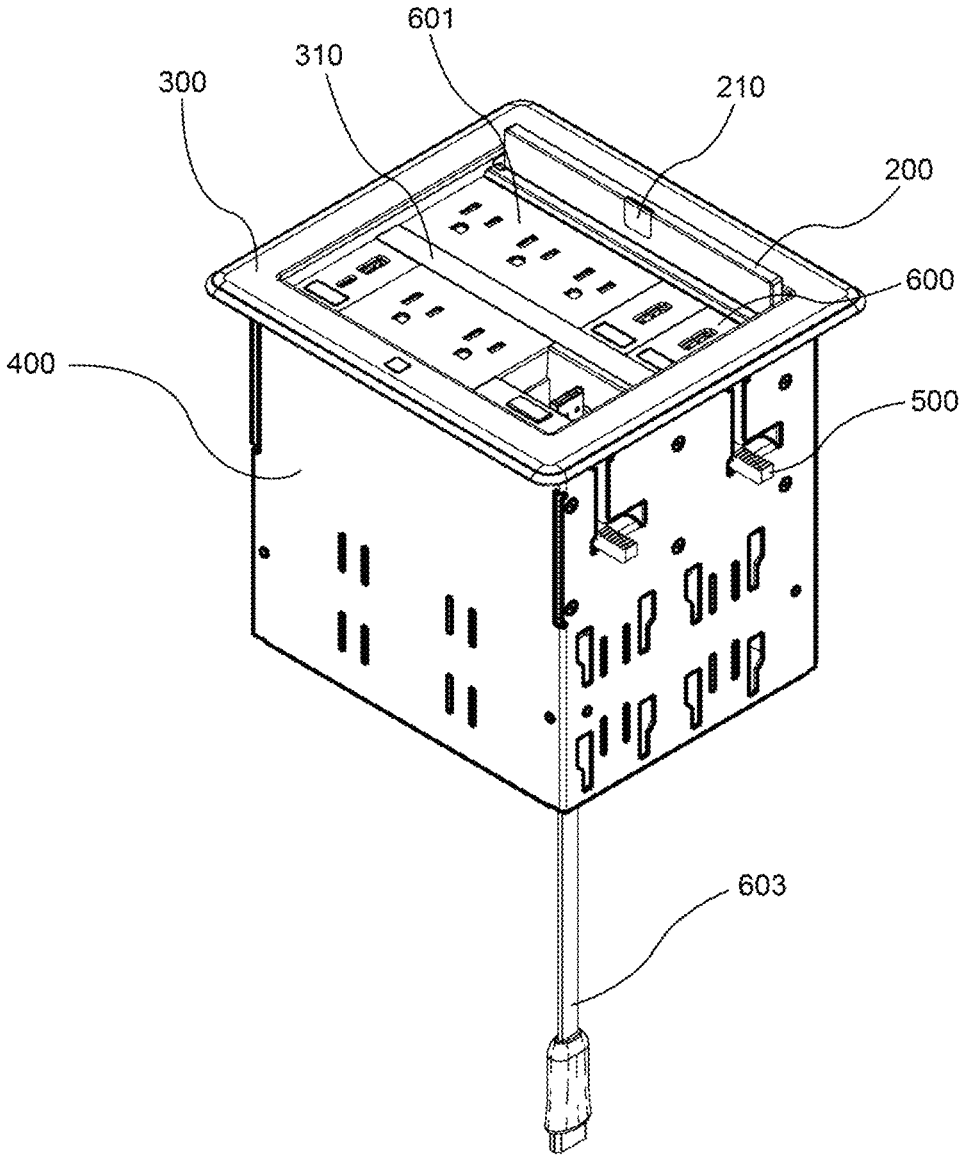
FIG. 1 is a front perspective view of a flip-top in accordance with an embodiment of the invention.

The following is a list of the major elements in the drawings:

100 Bus Board
110 Bus Board Data Connection
120 Bus Board Module Connection
140 Bus Board Cover
200 Lid Assembly
205 Lid
210 Steel Insert
211 Adhesive Pad
212 Steel Insert Recess
220 Lid Carrier
230 Torsion Spring
240 Linear Guide Carriage
250 Rotary Damper
260 Hinge Pin
300 Bezel
310 Bezel crossbar

400 Frame
450 Housing Back
500 Dog Ears
600 Video Module Insert
601 Power Module Insert 3-Gang
602 Gravity Retractor Module
603 Gravity Retractor Cable
604 Female NEMA Plug
606 Video Cable Plug
605 Pass-through Power Cable
650 USB Charger Module
651 USB A Cable Plug
652 USB A Cable Plug
700 Module Guides
701 Module Locking Bars
750 Module Rails
751 Module Rail Grove
760 3-Gang NEMA Module
850 Profile Guide Rail
860 Rack Gear
800 Door Guide Block
900 Lid Release Button
910 Lid Release Button Assembly
920 Lid Release Button Assembly Magnet
1000 Exploded Frame Modules
2000 Exploded Lid Assembly
3000 Exploded Housing Back
4000 Exploded Button Assembly

DETAILED DESCRIPTION OF THE INVENTION

FIG. 1 shows a flip-top enclosure according to one or more embodiments of the present invention. As can be seen, flip-top enclosure has a frame 400. When installed into a cutout opening of a table, frame 400 sits recessed below the table surface. Magnetic bezel 300 sits flush above the tabletop surface. As shown in FIG. 1, self-deploying dog-ears 500 can be used to secure the flip-top enclosure into an opening of the tabletop by deploying outwardly underneath the tabletop work surface. Magnetic bezel 300 includes a crossbar 310. The shown flip-top enclosure has a lid assembly 200 that includes a steel insert 210. A gravity retractor module cable 603 exits enclosure frame 400.

As can been seen in FIG. 1, the shown flip-top enclosure has six module inserts installed therein. As described more in detail below, module inserts are interchangeable with various module inserts of a different type and/or gang-size. Some of the module inserts used in FIG. 1 include a 3-gang power module insert 601, and a video module insert 600. The module configuration shown in FIG. 1 is only exemplary, and the types, sizes (gang-size), or locations of the module inserts used within the flip-top enclosure is not limited to the configuration shown.

Figure 2:
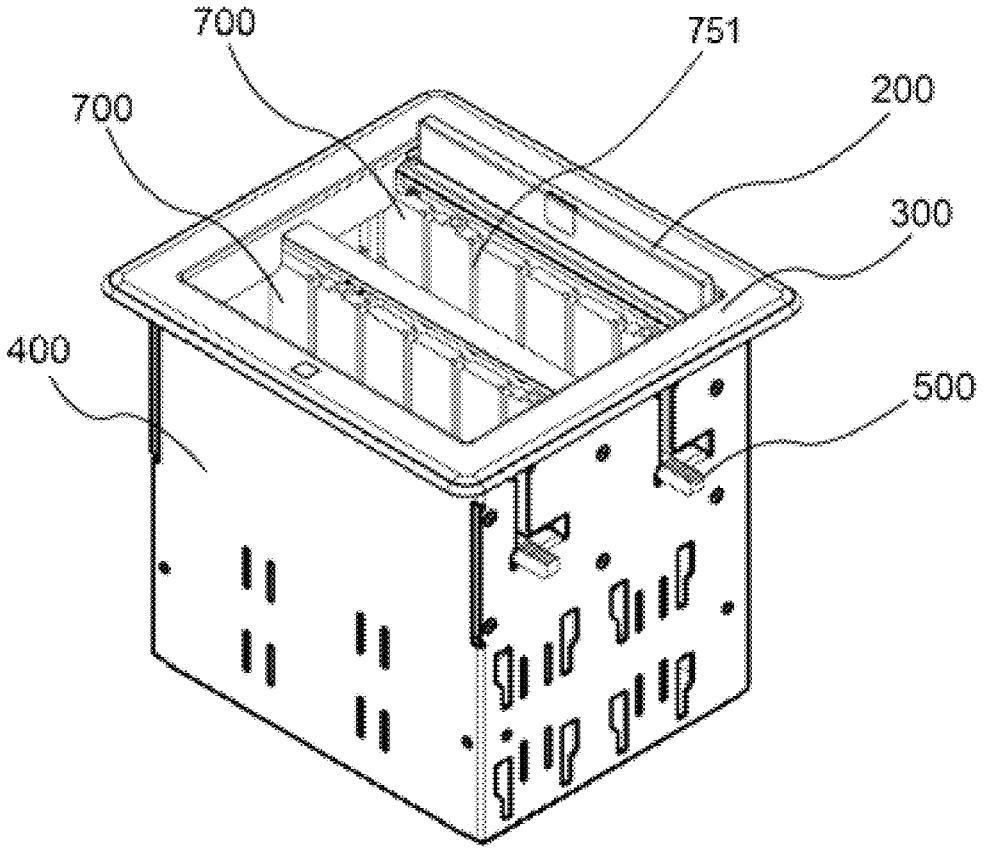
FIG. 2 is a front isometric view of the flip-top in FIG. 1 without any module inserts, in accordance with an embodiment of the invention.

FIG. 2 shows an embodiment of the flip-top enclosure without any modules inserts installed therein. As can be better seen in this view, a plurality of mutually opposing module guides 700 are arraigned to receive one or more module inserts. Opposing sides of the module guides 700 provide a plurality of module rail groves 751 to help align module insert interspacing and ensure proper orientation of any module inserts inserted into the flip-top enclosure. Module rail groves 751 may be distributed to help adjust module insert interspacing.

In an embodiment, the proper orientation of any module inserts to be inserted can be guaranteed by alternating the width of forward facing module rail groves 751. For example, forward facing module rail groves 751 can be made wider than rearward facing rail groves 751. In a like manner, rearward facing module rails can be made wider than the forward facing module rails make. Therefore, a module insert orientated backwards could not be inserted in to the module guides 700 because the wider module rail would be too wide to slide into the narrow module rail grove 751.

Figure 3:
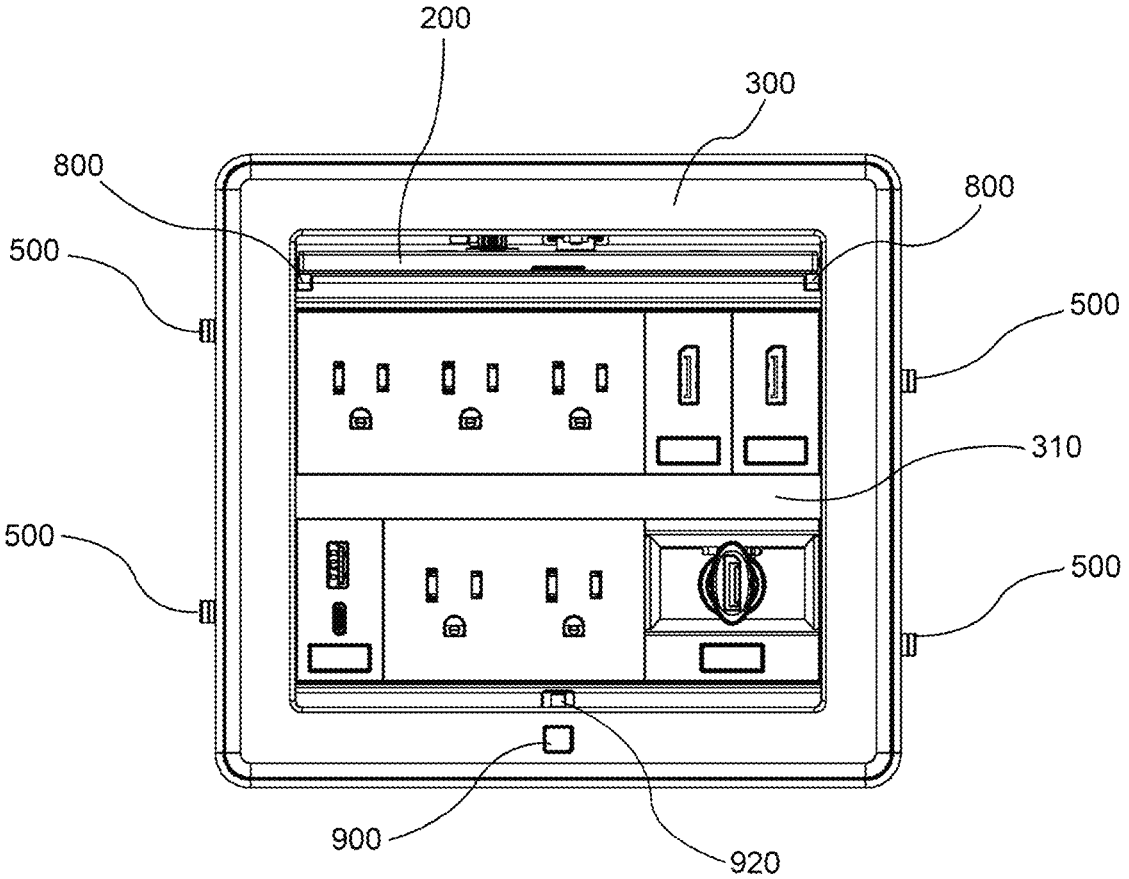
FIG. 3 is a top view of the flip-top in FIG. 1 in accordance with an embodiment of the invention.

FIG. 3 shows is a top view of the flip-top in FIG. 1. Taken from this view, it can be seen that lid release button assembly magnet 920 is exposed from the inside ledge of magnetic bezel 300. When the lid is in the closed position (closed lid position shown in other views), the lid release button assembly magnet 920 magnetically holds the lid in the closed position. When the lid release button 900 is depressed, it causes the lid release button assembly magnet 920 to swing away from the lid allowing the lid to escape the magnetic pull of the lid release button assembly magnet 920.

FIGS. 4-8 show embodiments of interchangeable module inserts that may be mounted within the tabletop enclosure in one or more embodiments of the invention. In all embodiments, it is preferable that the interchangeable module inserts have one or more set of opposing module rails 750 disposed along their front and back for slidably engaging a corresponding number of module rail groves 751 (shown in FIG. 2) of the opposing module guides 700 (shown in FIG. 2) of the flip-top enclosure.

Figure 4:
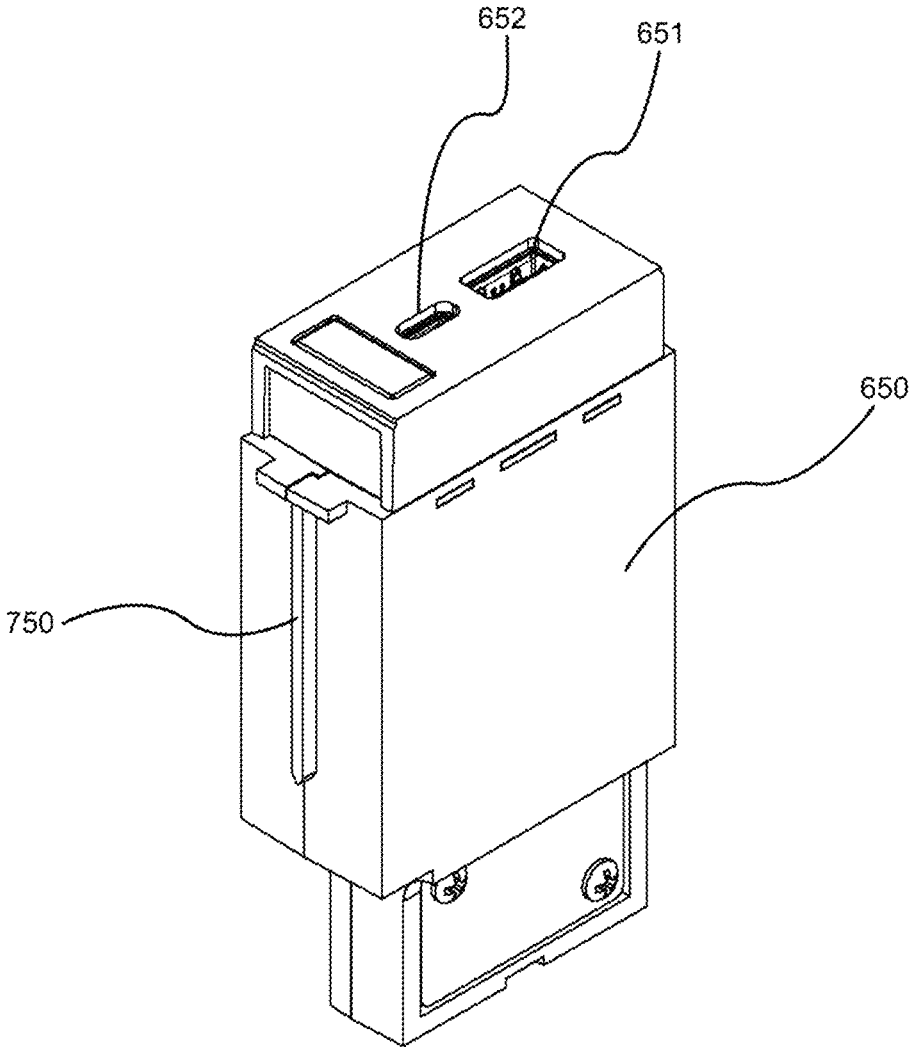
FIG. 4 is a front isometric view of a module insert in accordance with one embodiment of the invention.

Now turning to FIG. 4, in some embodiments a module insert can be 1-gang sized USB charger module 650 that provides power to an external device via an Universal Serial Bus ("USB") C (Type-C) cable plug 652 or an USB A (Type-A) cable plug 651. In an embodiment, the flip-top enclosure provides an interface for connecting an information source to a presentation device. Connections may also be made to other interconnected devices, for example, a conference room head-end connected to a presentation device. Presentation devices include but are not limited to display equipment, screen projectors, large flat screens, audio speakers, and the like. In some embodiments, a cable is used in order to connect to a module insert installed within the flip-top enclosure. In other embodiments, a pass-through cable provided by a pass-through module insert can be used.

In some embodiments, module inserts only pass power to the devices connected to it. An example use would to be recharge a battery-powered device, like a cell phone. Some module inserts act as a data interface. In an embodiment, for example, data from a connected information source can directly delivered to a head-end for a presentation device. In another embodiment, data from a connected information source is digitally encoded by audio/video encoders into data packets suitable for transmission via a connected LAN (local area network) by encoding their output into network-compatible digital format and transmitting such information via the local area network. Encoded video signals may be recovered from the network signals by a video decoder before being presented to a presentation device. A presentation device can be located in the same or any number of rooms local or remotely located.

Figure 5:
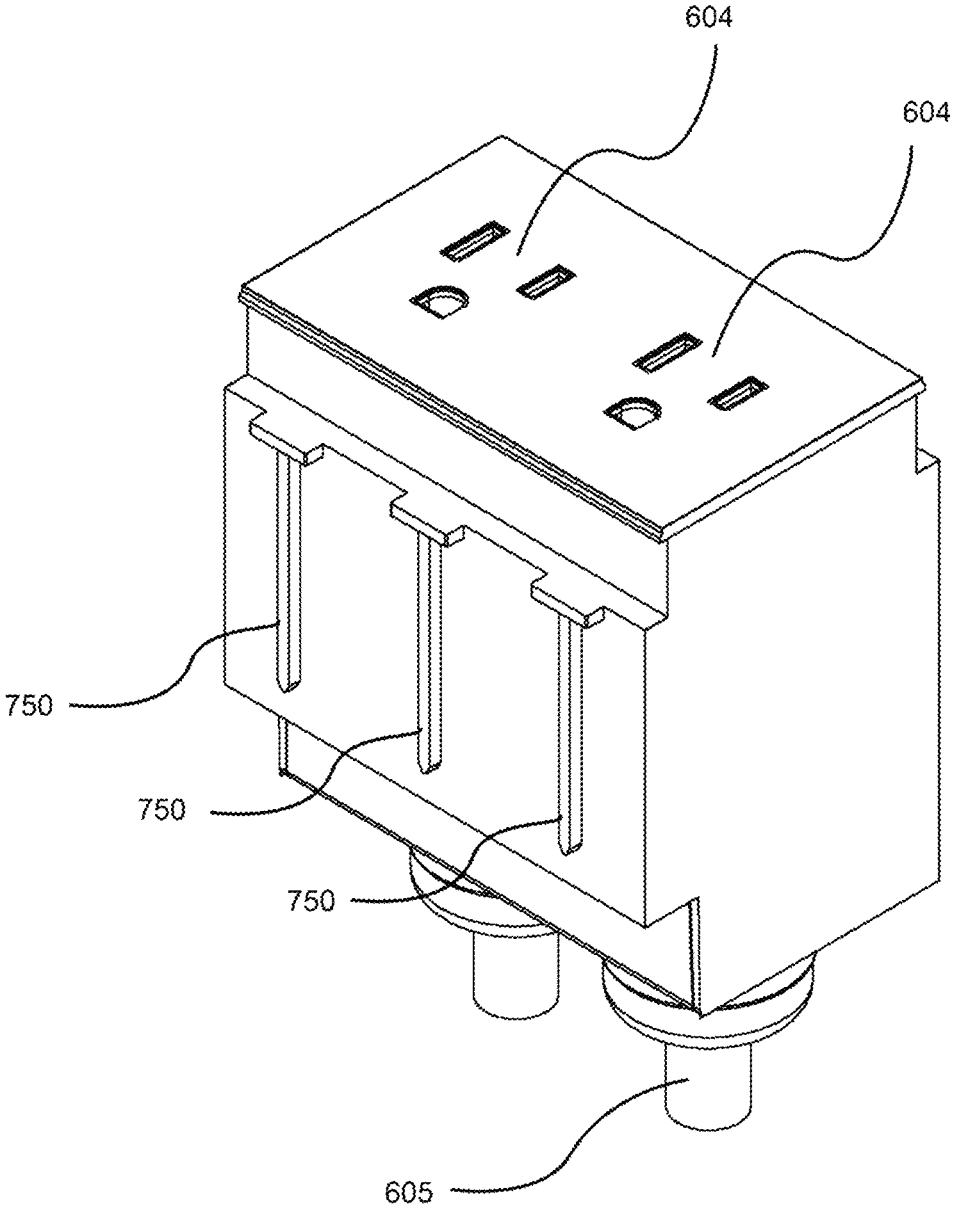
FIG. 5 is a front isometric view of a 2-gang power module in accordance with an embodiment of the invention.

Referring now to FIG. 5, in some embodiments a module insert can be 2-gang sized power module having a one or more female NEMA Plugs 604. Additional module rails 750 can be provided in embodiments using 2-gang sized module inserts. In some embodiments a module, inserts may include one or more pass-through power cables 605 to provide, for example, mains power.

Figure 6:
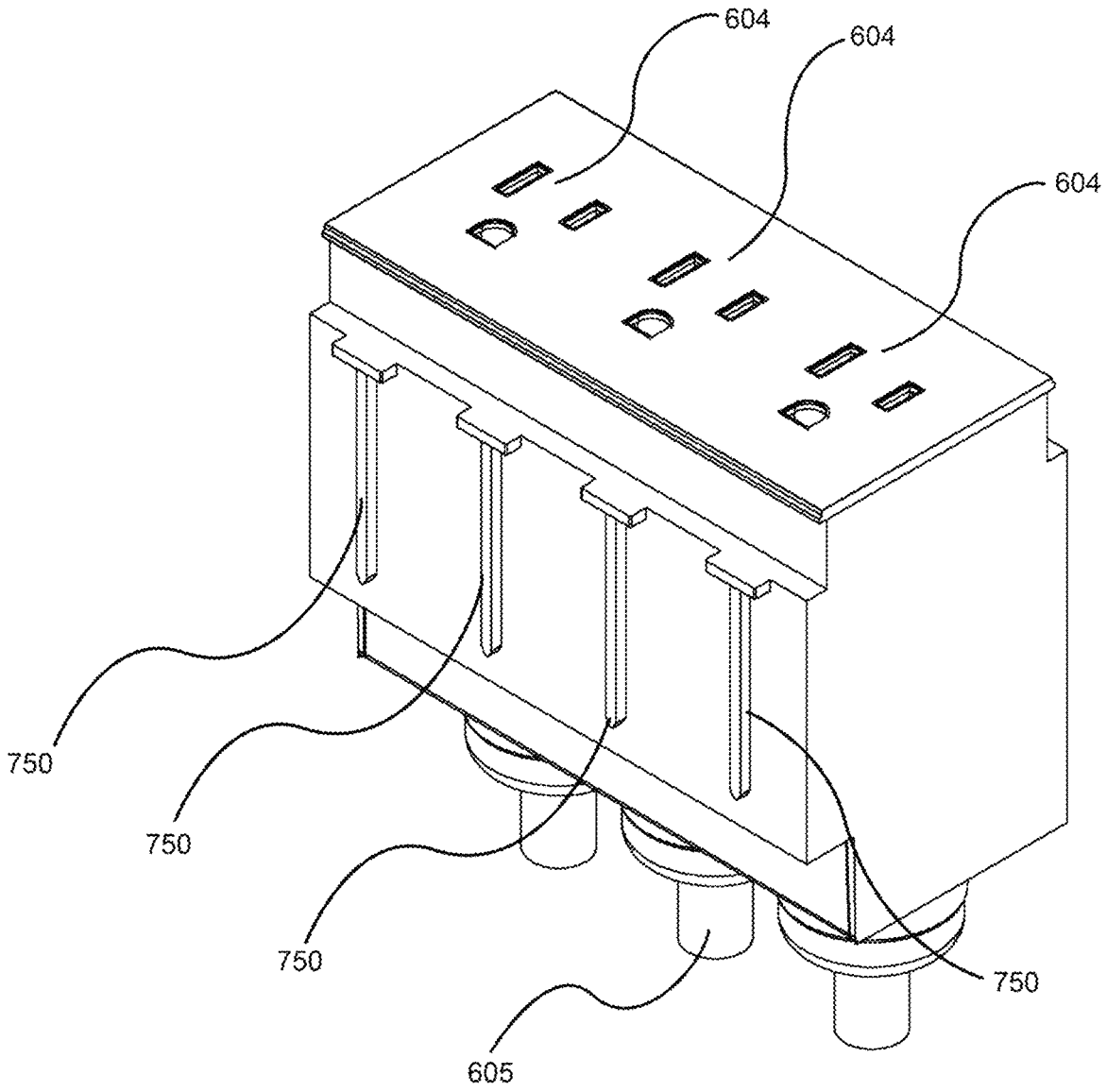
FIG. 6 is a front isometric view of a 3-gang power module in accordance with an embodiment of the invention.
Figure 7:
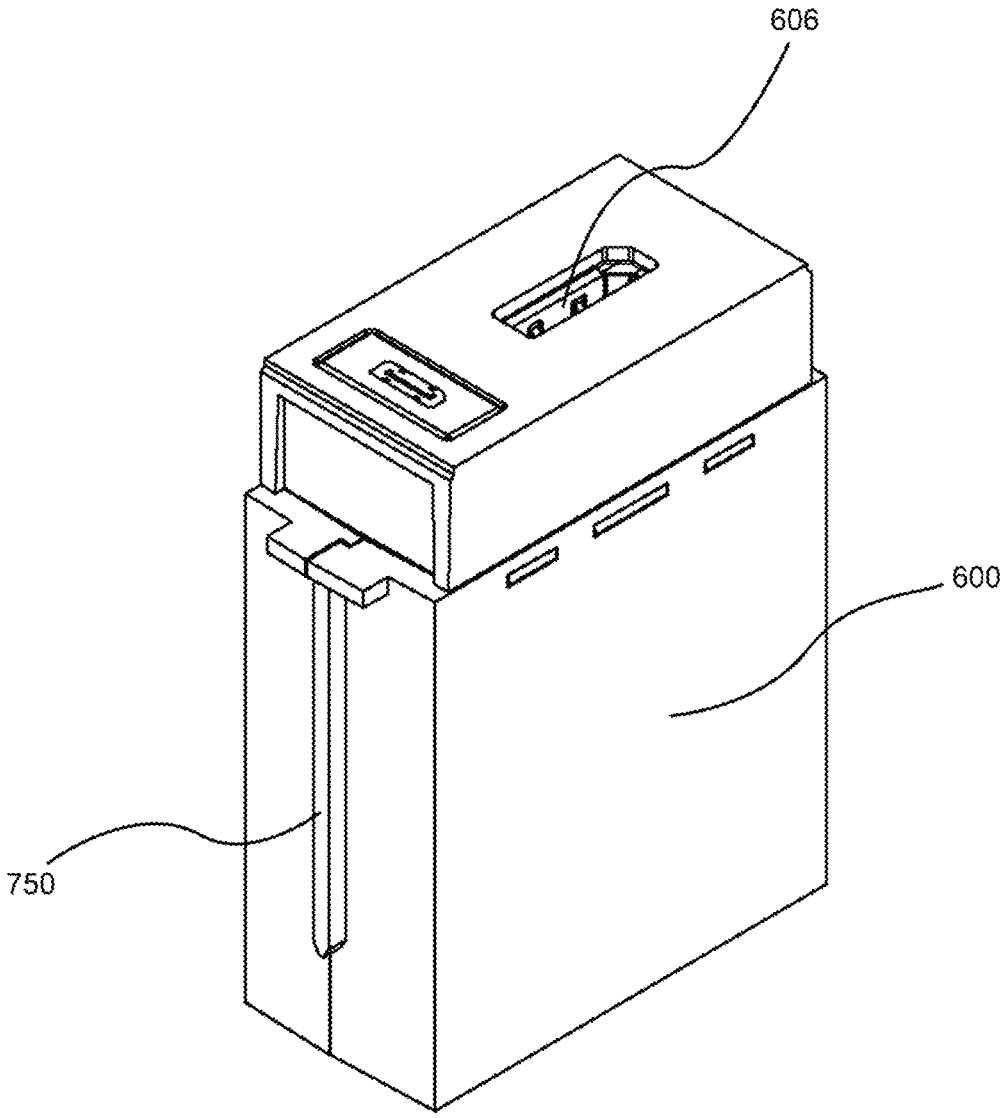
FIG. 7 is a front isometric view of a video module in accordance with some embodiments of the invention.
Figure 8:
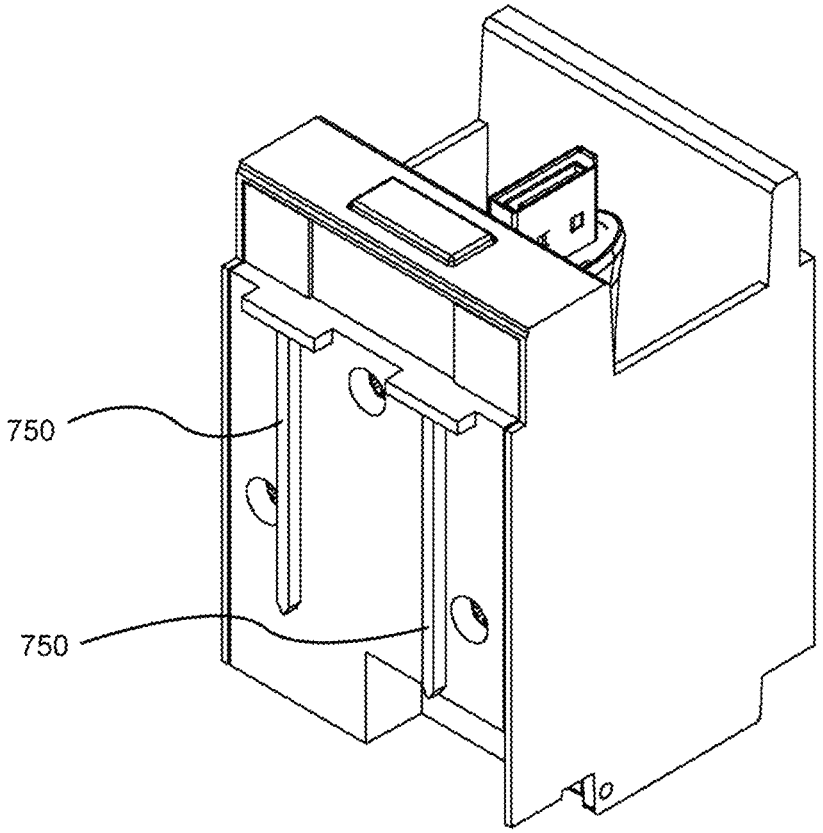
FIG. 8 is a front isometric view of a video pass-through module in accordance with some embodiments of the invention.

Referring now to FIG. 6, in some embodiments a module insert is 3-gang sized. In these embodiments, additional module rails 750 are provided to correspond with the larger gang size. In these embodiments, additional female NEMA plugs 604 and/or pass-through power cables 605 may be provided. Now turning to FIG. 7, in some embodiments a module insert can be 1-gang size video module insert 600 having one or more a video cable plugs 606. In some embodiments, module inserts may be a gravity retractor module with a cable passed through the module insert as shown in FIG. 8.

Figure 9:
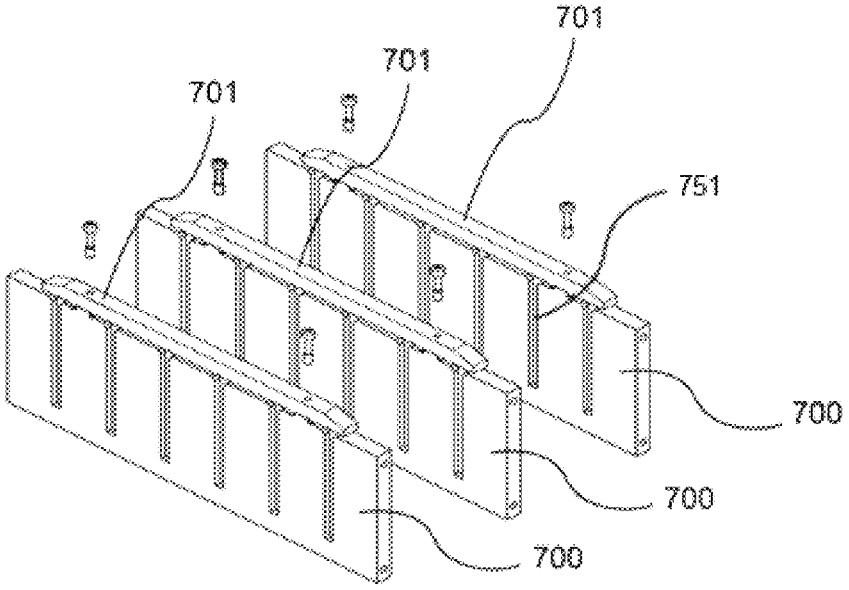
FIG. 9 is a front isometric view of the module guides and module locking bars of the flip-top in FIG. 1 according to an embodiment of the invention.

FIG. 9 shows three module guides 700 having a plurality of module rail groves 751. Module locking bars 701 can be used to secure all installed module inserts after they have been slid in to module rail groves 751.

Figure 10:
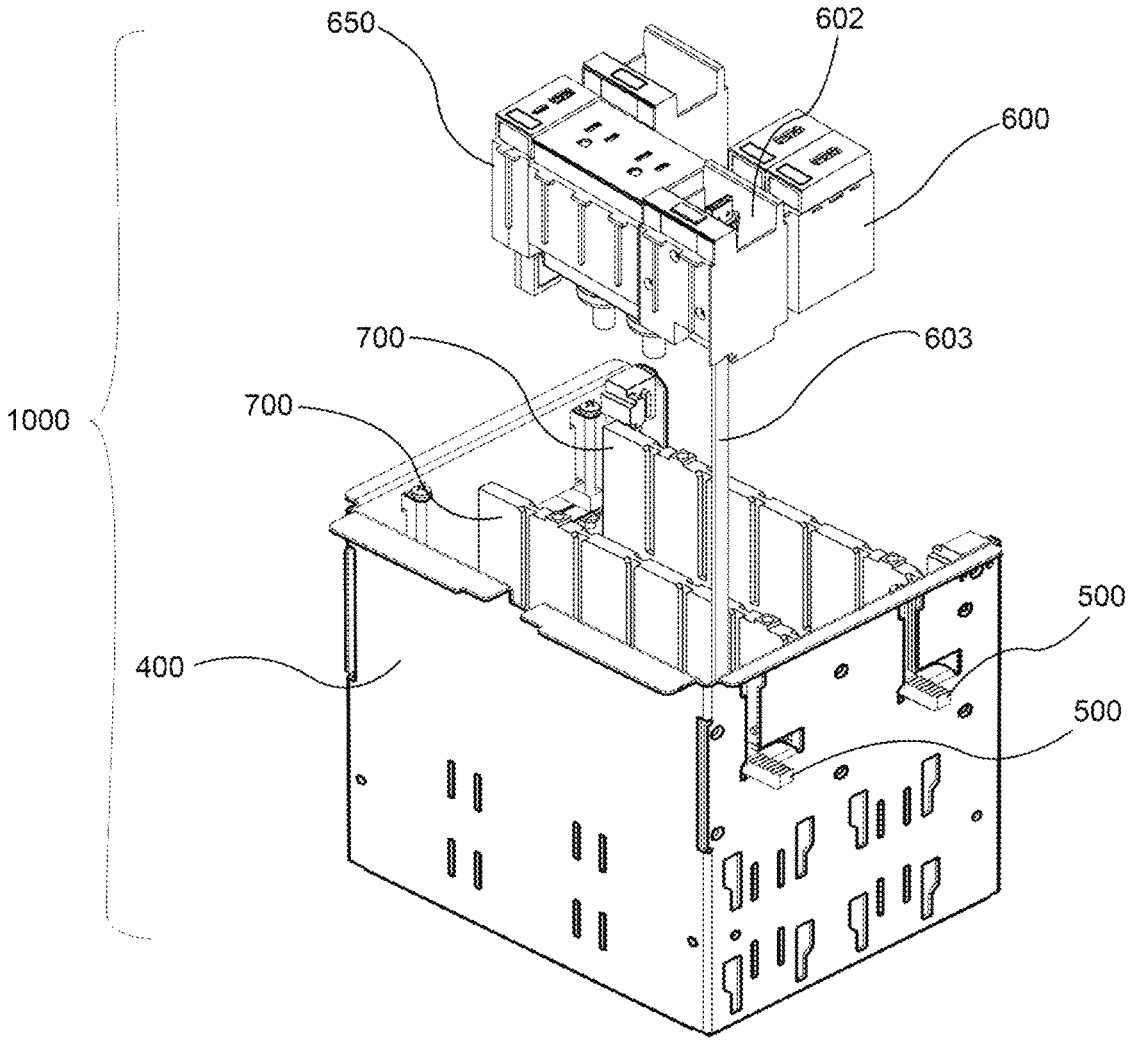
FIG. 10 is an exploded front isometric view of the flip-top in FIG. 1 showing one or more of the modules shown in FIGS. 4-8, in accordance with an embodiment of the invention.
Figure 11:
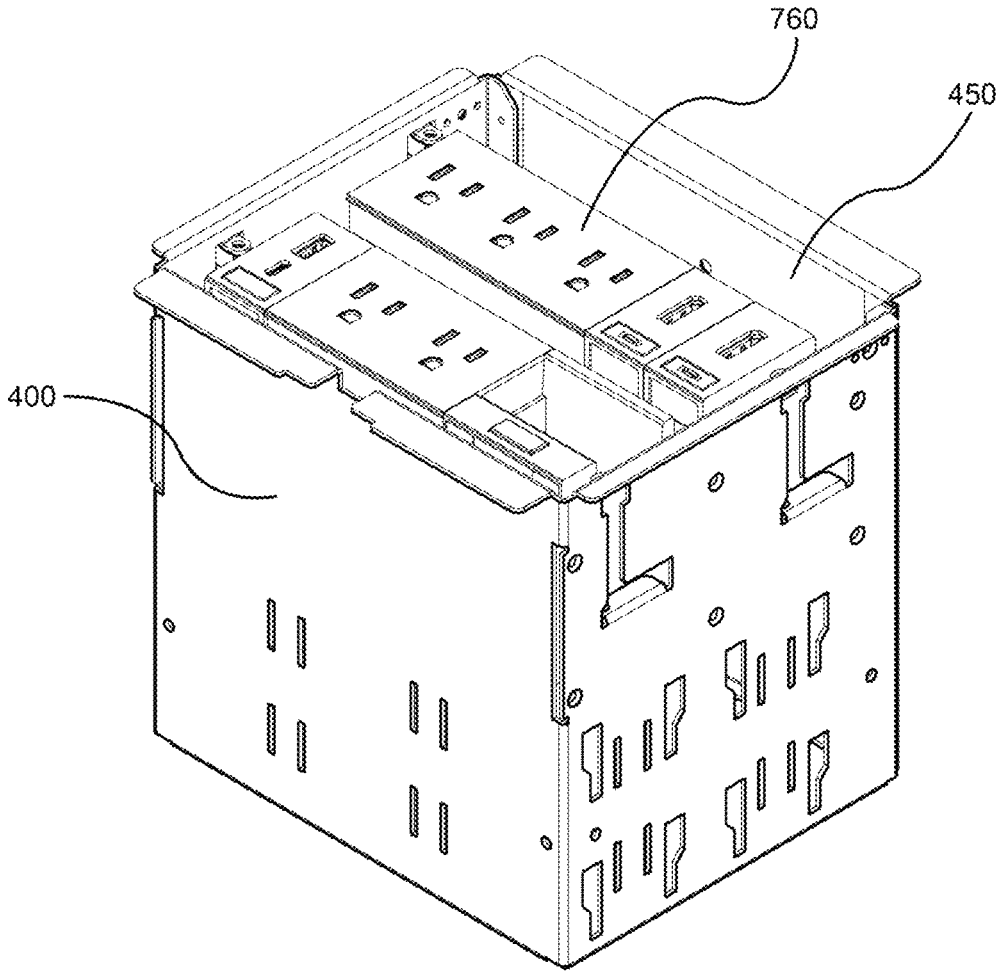
FIG. 11 is a front isometric view of one or more modules like those shown in FIGS. 4-8, inserted within the flip-top in FIG. 1, in accordance with an embodiment of the invention.

FIG. 10 shows an exploded view 1000 of a flip-top enclosure. As can be seen, cable 603 passes through gravity retractor module 602. FIG. 11 shows a flip-top enclosure with several components removed in order to show the housing back 450

Figure 12:
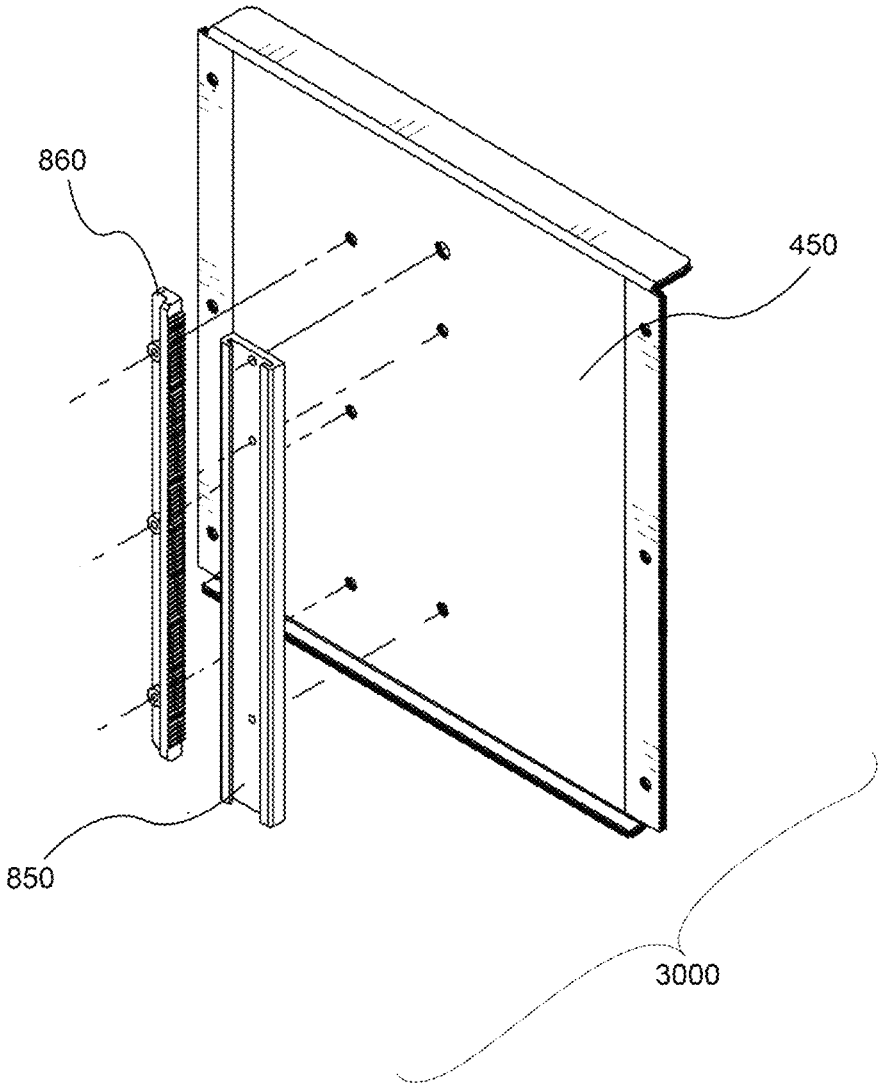
FIG. 12 is an exploded isometric view of the housing back of the flip-top in FIG. 1 showing a profile guide rail and rack gear in accordance with an embodiment of the invention.

FIG. 12 shows an exploded housing back 3000 of a flip-top enclosure according to the one or more embodiments. In these embodiments, a rack gear 860 and profile guide rail 850 are secured to housing back 450.

Figure 13:
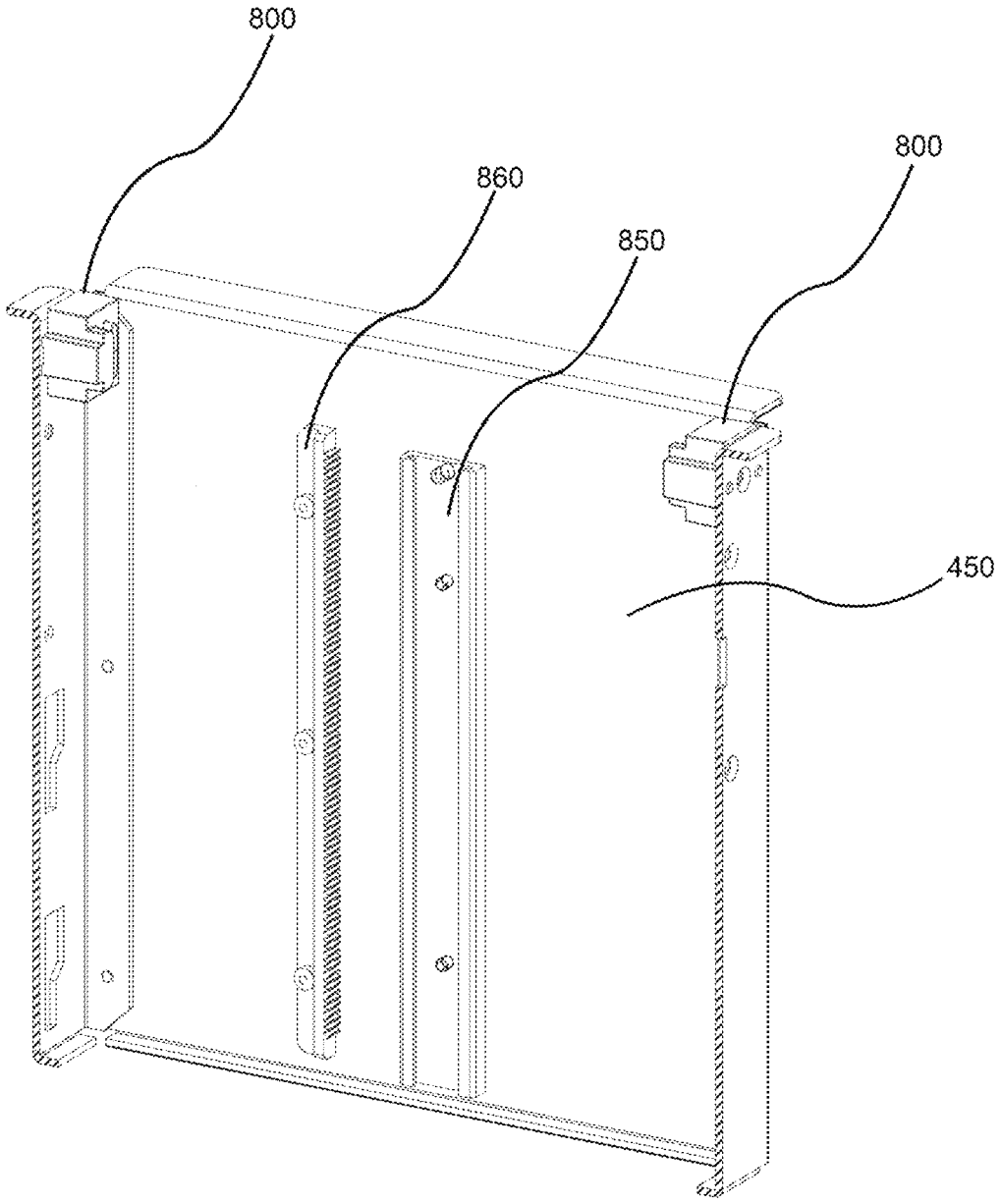
FIG. 13 is a front isometric sectional view of the housing back of the flip-top in FIG. 1 showing the profile guide rail, rack gear, of FIG. 12, and the position of the door guide blocks of the flip-top in FIG. 1, in accordance with an embodiment of the invention.

FIG. 13 shows rack gear 860 and profile guide rail 850 assembled to housing back 450. A door guide block 800 sits adjacent to topmost inside of housing back 450.

Figure 14:
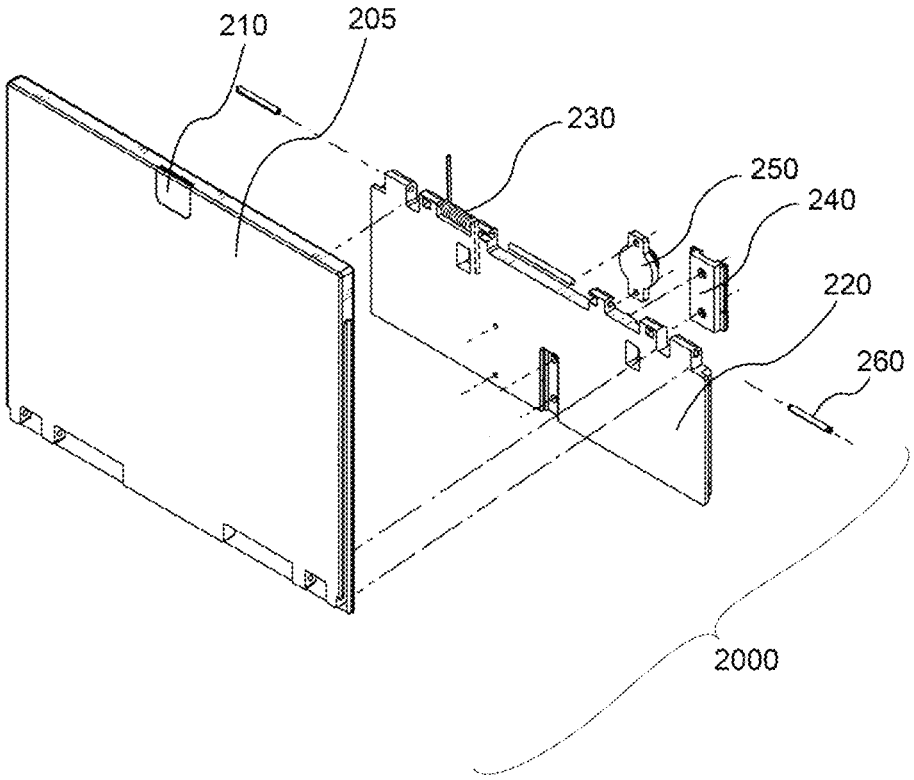
FIG. 14 is an exploded isometric view of the lid assembly of the flip-top in FIG. 1, in accordance with an embodiment of the invention.
Figure 15:
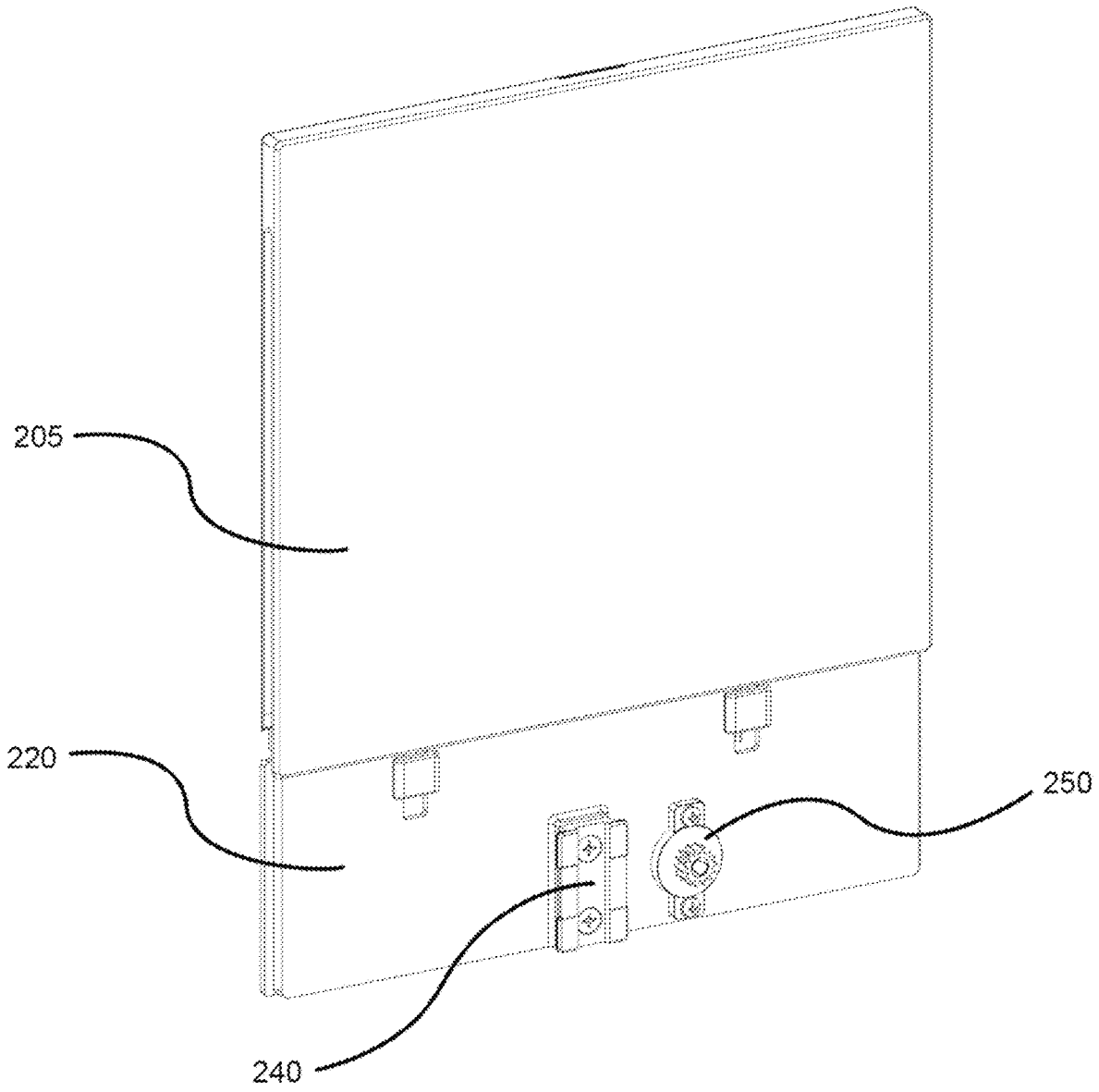
FIG. 15 is a rear isometric view of the lid assembly of the flip-top in FIG. 1, in accordance with an embodiment of the invention.

FIG. 14 shows an exploded view of an embodiment of the lid assembly shown in FIG. 15. Lid 205 is pivotally connected to lid carrier 220 using one or more hinge pins 260. Lid 205 includes steel insert 210 so that it touches lid release button assembly magnet 920 (shown in FIGS. 27-29) when lid 205 is in the closed position. The lid 205 is biased upwardly by a torsion spring 230. Rotary damper 250 provides the dampening forces to permit the entire lid assembly to recess at a smooth rate of decent into the flip-top enclosure and linear guide carriage 240 provides linear guidance for the lid assembly decent during the recess. FIG. 15 shows a rear view of the assembled lid assembly shown in FIG. 14.

Figure 16:
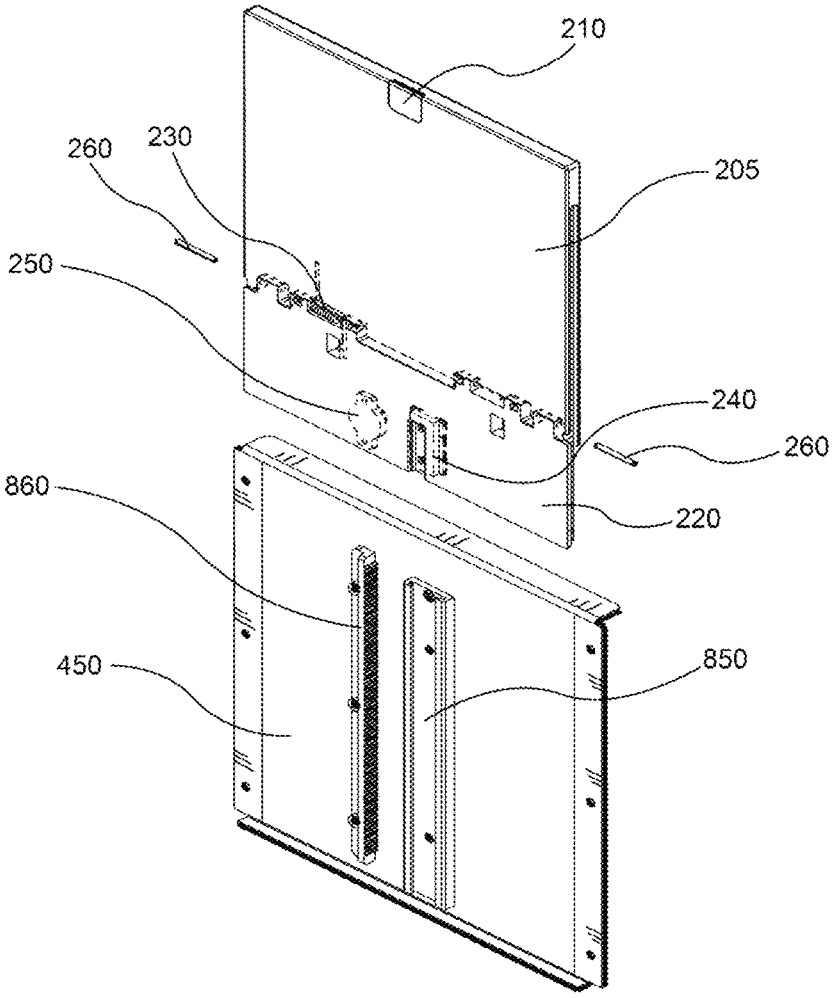
FIG. 16 is an exploded isometric view of the housing back and lid assembly of the flip-top in FIG. 1, in accordance with an embodiment of the invention.

FIG. 16 shows an exploded view of the housing back and lid assembly. Referring to FIG. 16, note that when both the housing back and lid assembly are assembled together, the rack gear 860 and rotary damper 250 interface, and mesh. Likewise, linear guide carriage 240 slides up and down within profile guide rail 850 (FIGS. 18 and 19 show this in detail).

Figure 17:
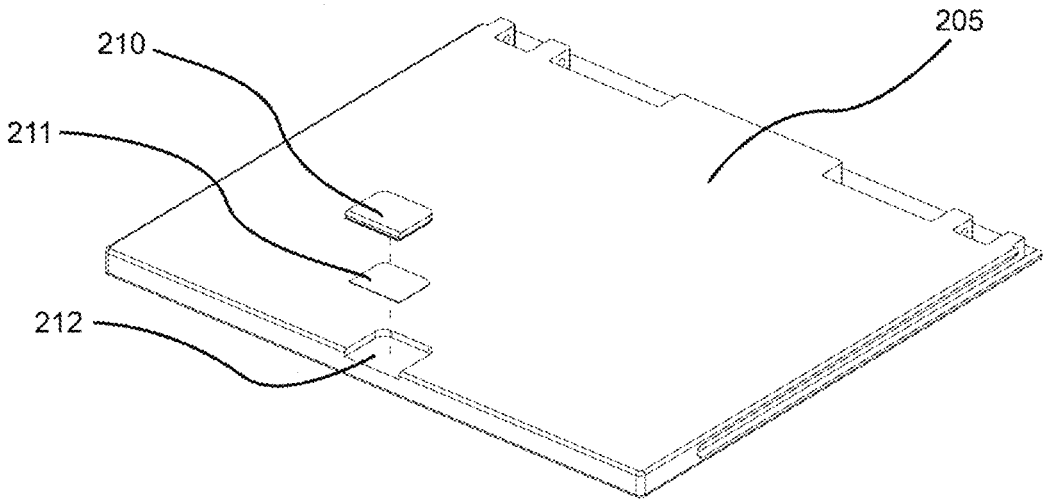
FIG. 17 is an exploded isometric view of the steel insert, adhesive pad, and steel insert recess of the lid of the flip-top in FIG. 1, in accordance with an embodiment of the invention.

FIG. 17 shows an exploded view of one or more embodiments of a flip-top lid utilizing a steel insert. In these embodiments, an adhesive pad 211 may be used to secure steel insert 210 within a steel insert recess 212 of lid 205.

Figure 18:
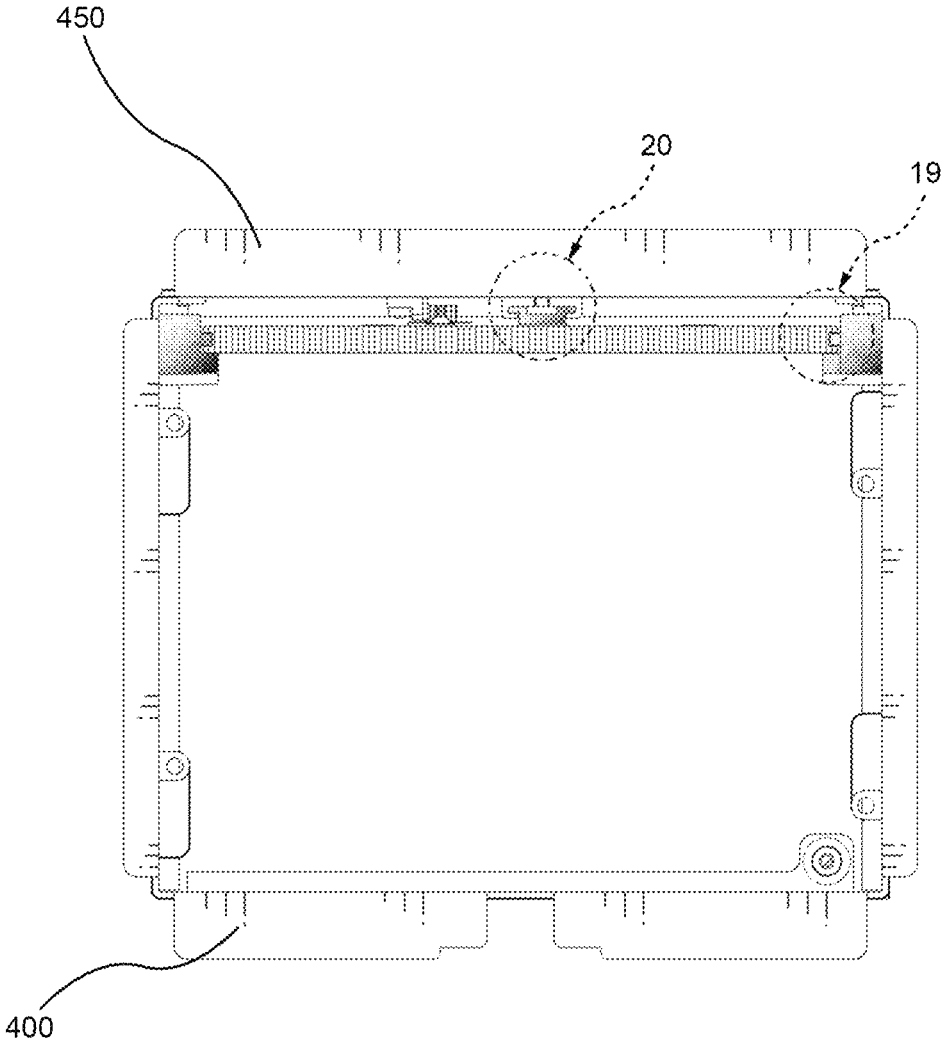
FIG. 18 is a top view of the flip-top in FIG. 1, in accordance with an embodiment of the invention.
Figure 19:
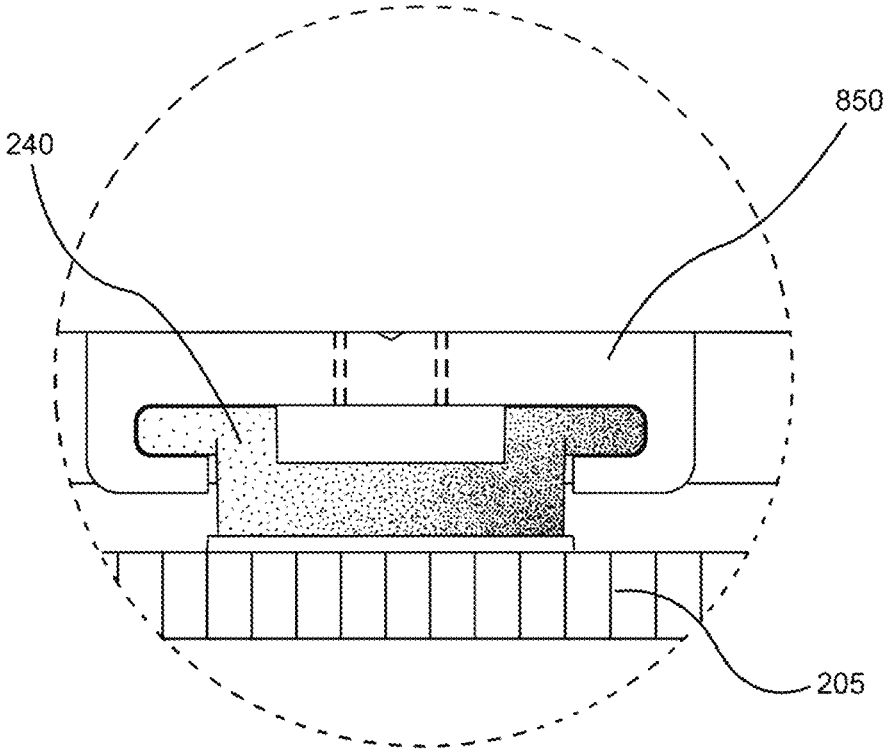
FIG. 19 is a portion of a top view of the flip-top in FIG. 18 enlarged for magnification purposes.
Figure 20:
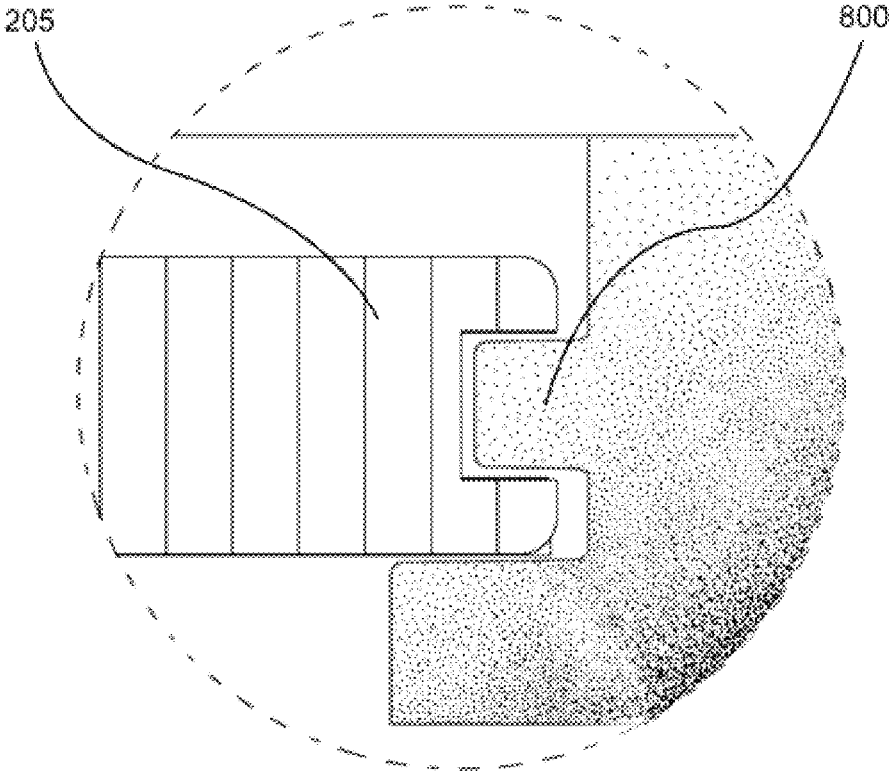
FIG. 20 is a portion of a top view of the flip-top in FIG. 18 enlarged for magnification purposes.

FIG. 18 is a top view of the flip-top in FIG. 1 showing frame 400 and housing Back 450. FIG. 19 is an enlarged portion in FIG. 18, showing linear guide carriage 240 of lid 205 inserted within profile guide rail 850. FIG. 20 is an enlarged portion of FIG. 18, showing the sides of lid 205 slidably engaging one of the door guide blocks 800.

Figure 21:
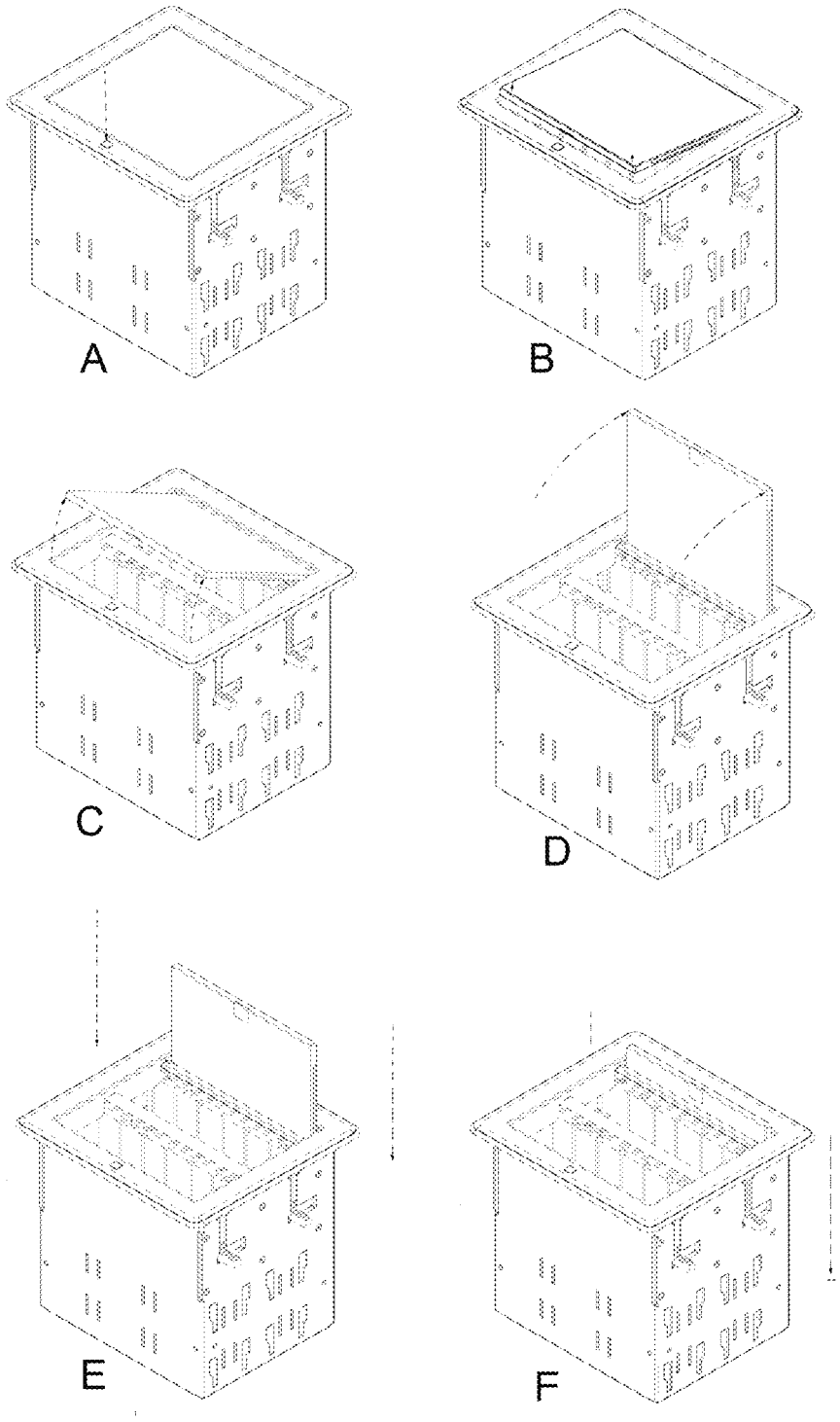
FIG. 21 is a series of front isometric views showing the flip-top lid in FIG. 2 springing upwardly to a vertical position and then afterwards recessing by dropping down into the flip-top frame, in accordance with an embodiment of the invention

FIG. 21 shows intermediate positions of the self-actuated lid springing open as it pivots up along its rear edge. After a user presses the lid release button, the lid begins to automatically springs open (see A, B, and C). The only interaction needed by a user to start lid opening sequence, is the pressing of the lid release button. The lid is biased upwardly by a hinge-pin retained torsion spring. The lid release button permits the release of the lid release button assembly magnet and thereby permit the torsion spring to springably act upon the lid and cause it to pivot upward about its hinge. After the lid has spring open and is standing vertically upright (see D) the gravitational forces direct the lid assembly and cause it to recess by sliding downwardly into the tabletop enclosure (See E) until it is substantially recessed (See F).

Figure 22:
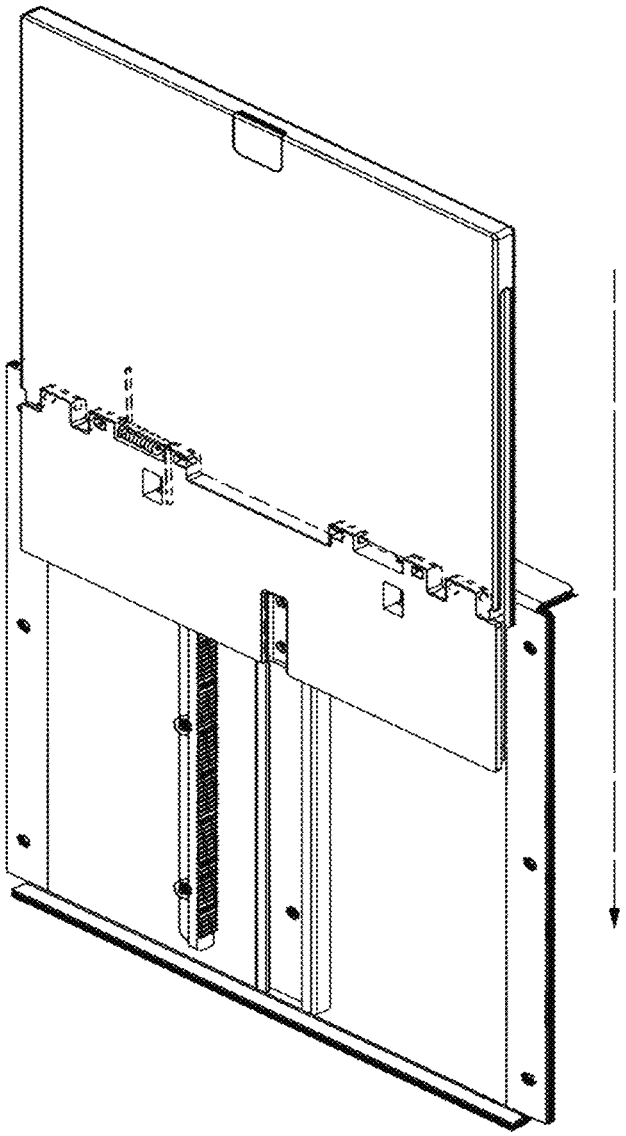
FIG. 22 is a front partial isometric view showing the flip-top lid assembly recessing along the profile rail while engaging the rack gear, in accordance with an embodiment.
Figure 23:
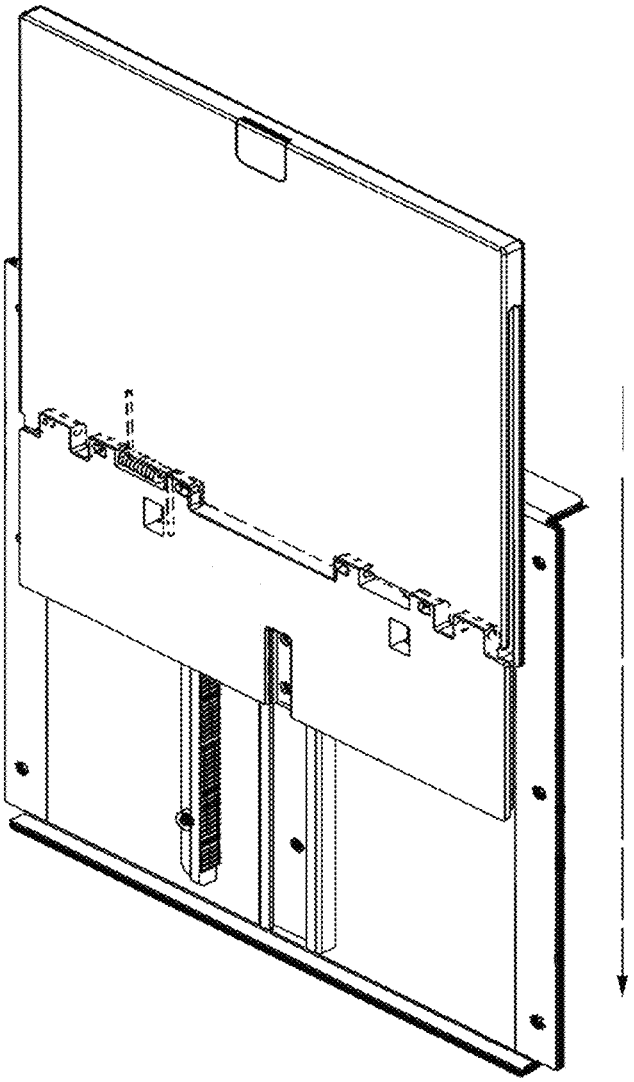
FIG. 23 is a front isometric view showing the flip-top lid assembly in FIG. 22 continuing to recess along the profile rail while engaging the rack gear, in accordance with an embodiment.
Figure 24:
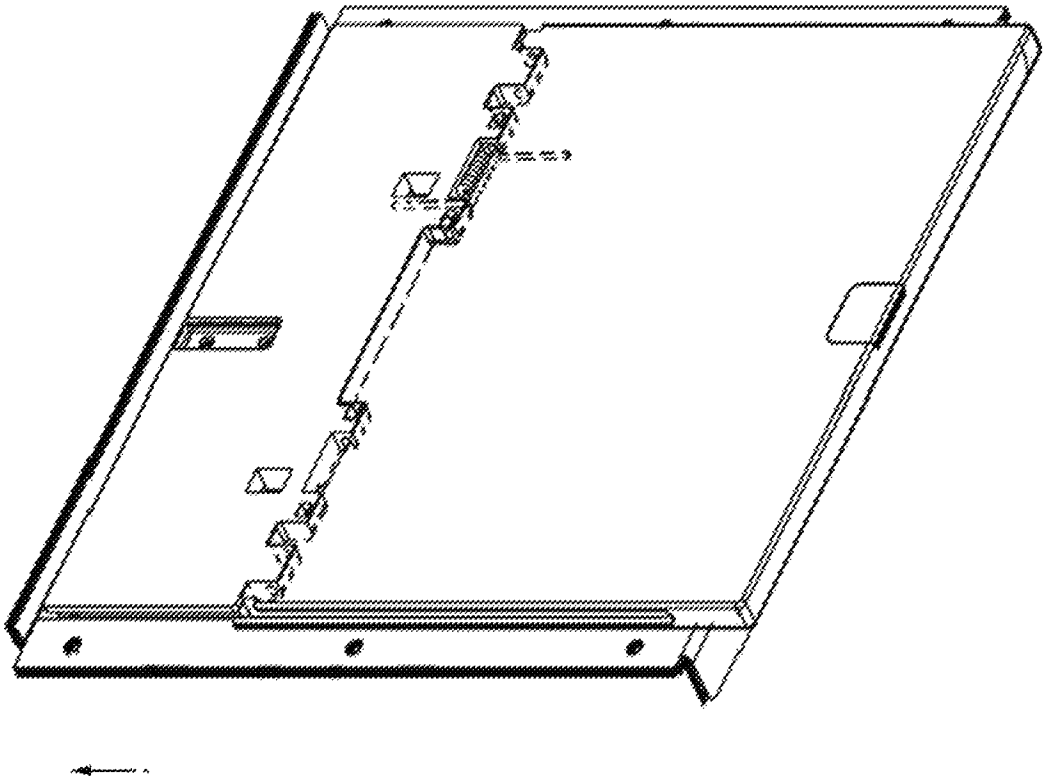
FIG. 24 is a front isometric view showing the flip-top lid assembly in FIG. 23 after it has fully recessed, in accordance with an embodiment.

FIGS. 22-24 show a front partial view of the flip-top lid assembly recessing along the profile rail while engaging the rack gear of the housing back. Gravitational forces begin the recessing procedure subsequent to the lid has completing its spring upward to the open position.

Figure 25:
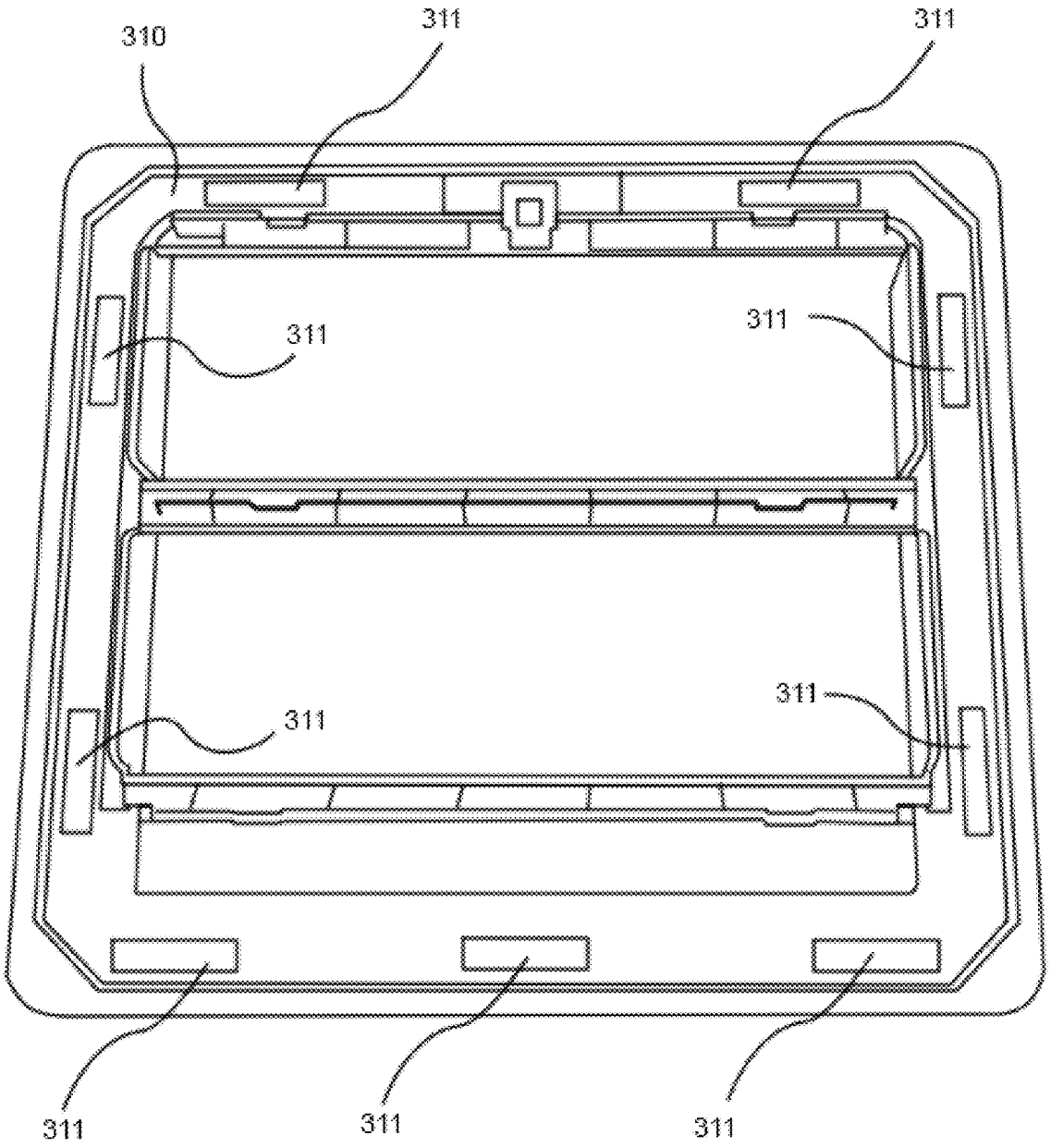
FIG. 25 is a bottom perspective view of the bezel of the flip-top enclosure, in accordance with an embodiment of the invention.

FIG. 25 shows the bottom of magnetic bezel 300. In an embodiment, magnetic bezel 300 has a plurality of magnets 311 disposed thereunder to magnetically secure to the top perimeter of the tabletop enclosure frame. The magnets can be selected from any appropriate magnet types including, neodymium iron boron (NdFeB), samarium cobalt (SmCo), alnico, ceramic, or ferrite. The top perimeter of the tabletop enclosure frame can be constructed from a ferromagnetic metal. Examples include iron, nickel, cobalt, gadolinium, dysprosium, or alloys that contain ferromagnetic metals, such as steel.

Figure 26:
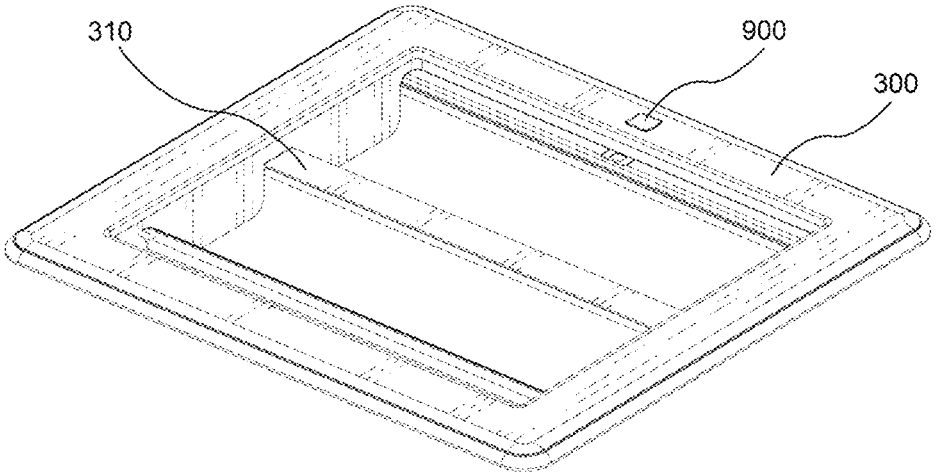
FIG. 26 is a front isometric view of the bezel of the flip-top in FIG. 1, in accordance with an embodiment of the invention.

FIG. 26 shows front isometric view of the magnetic bezel 300. In some embodiments, the crossbar 310 of magnetic bezel 300 may acts to conceal any included module locking bars 701 (shown in FIG. 9). Lid release button 900 is exposed through Bezel 300.

Figure 27:
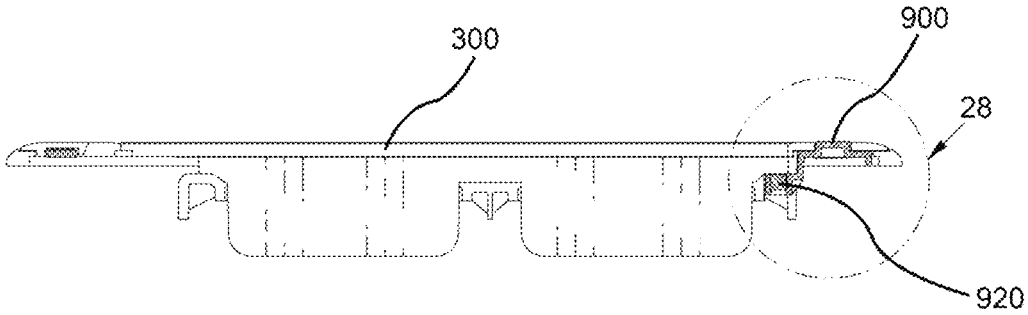
FIG. 27 is a side sectional view of the bezel in FIG. 26 showing the release button assembly of the lid, in accordance with an embodiment of the invention.

FIG. 27 shows an embodiment of a the bezel in FIG. 26 showing a release button assembly that includes a lid release button 900 connected to a lid release button assembly magnet 920.

Figure 28:
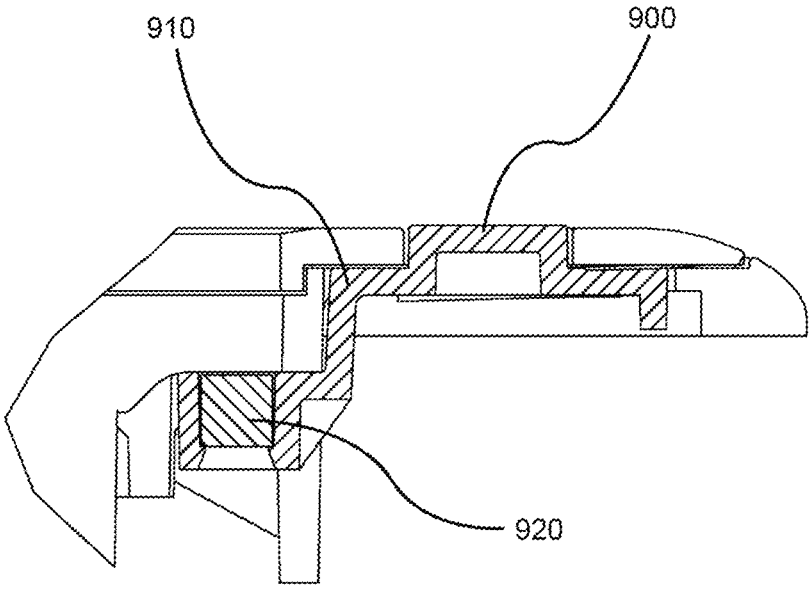
FIG. 28 is a portion of the side view of the bezel in FIG. 27 enlarged for magnification purposes
Figure 29:
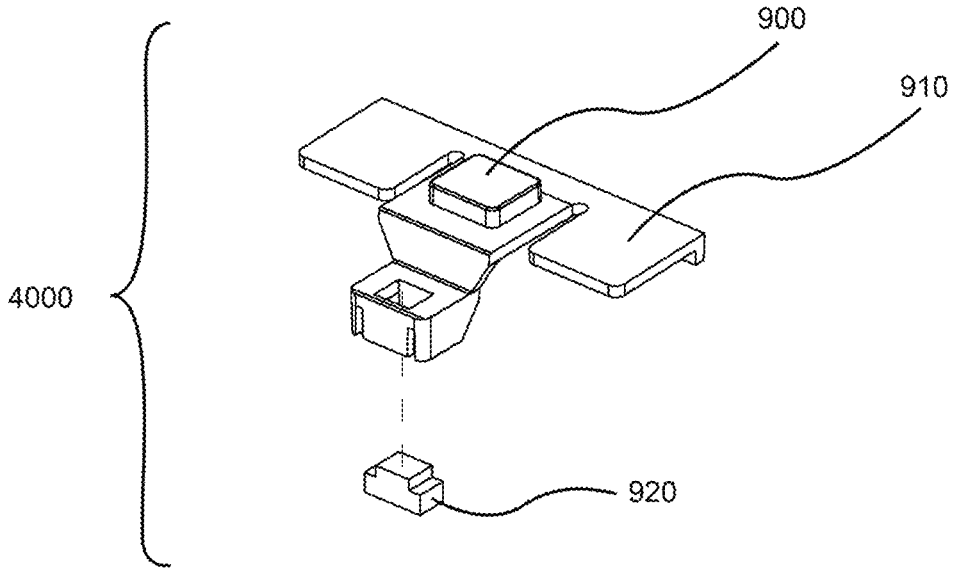
FIG. 29 is an exploded isometric view of the release button assembly showing the magnet used to capture and hold the lid in the closed position, in accordance with an embodiment of the invention.
Figure 30:
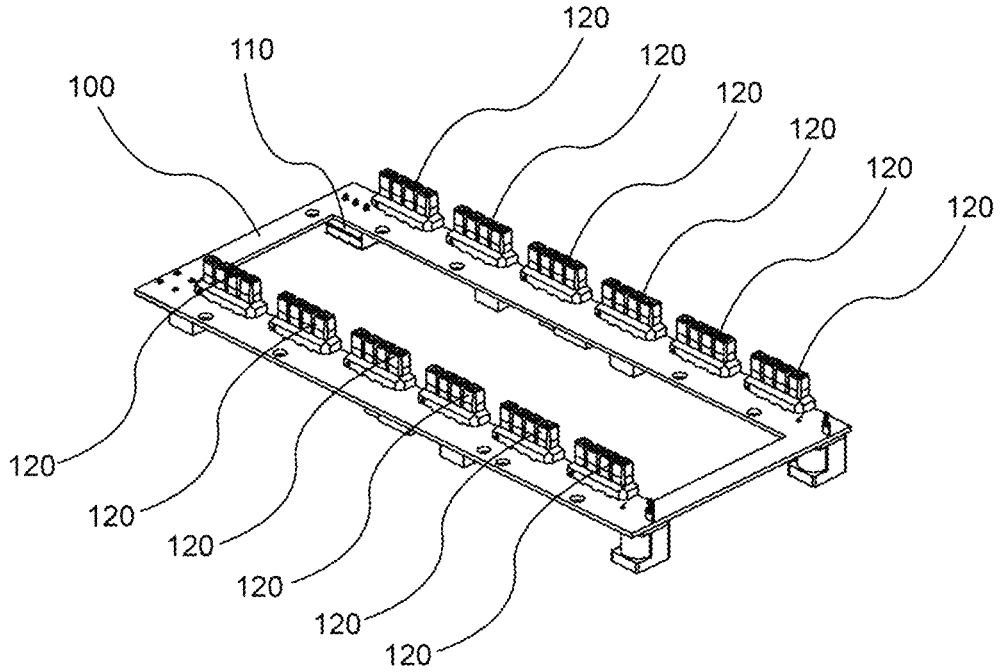
FIG. 30 is a front isometric view showing the bus board, in accordance with an embodiment of the invention.

Now referring to FIG. 28 (portion of FIG. 27 enlarged for magnification), pressing the lid release button exposed through the top surface of the magnetic bezel causes the lid release button assembly 910 and its embedded lid release button assembly magnet 920 to pitch downwardly and away from any lid or steal insert included thereon. It is preferable that a flip-top lid can held closed by the magnetic grabbing force of magnet 920, and be released by pitching magnet 920 downwardly. The release occurs because the distance between the magnet and lid is increased when pitching magnet 920 down thus allowing the torsion spring's bias to overcome the magnetic field of the distanced lid release button assembly magnet 920. FIG. 29 shows an exemplary embodiment of a lid release button assembly 910 showing a magnet 920 used to capture and hold a lid in the closed position.

In an embodiment, the flip-top enclosure may have a control system installed within its frame. The control system could be used to communicate with a conference room head-end, for example, to provide control commands to one or more information sources. Examples of information sources include DVD players, television receivers, video cameras, CD players, networked media servers, laptop computers, tablets, mobile phones, and the like.

FIG. 30-34 show a bus board for use in a flip-top enclosure according to one embodiment. In this embodiment, one or more module inserts care configured with a bus board plug that connects to a bus board module connection 120 when the module is inserted into a flip-top enclosure. Embodiments utilizing using module guides and module rails ensure that the bus board plug and bus board module connection 120 are properly aligned during module insert insertion. The use of module locking bars 701 (see FIG. 9) further insures that module inserts are not accidentally pull out of the flip-top enclosure.

Figure 31:
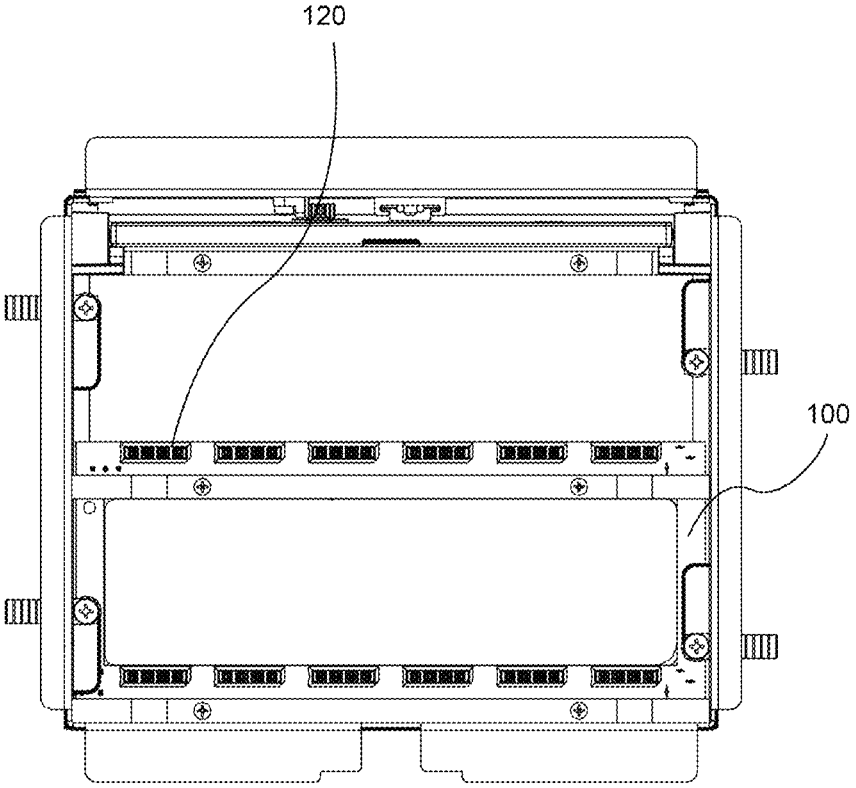
FIG. 31 is a top view showing the exposed Bus Board Module Connections of the Bus Board Assembly as installed within the flip-top in FIG. 1, in accordance with an embodiment of the invention.

FIG. 31 shows is a top view of the exposed bus board module connections 120 of the bus board assembly 100 as installed within a flip-top. In some embodiments a module insert' bus board plug mates with one of the corresponding exposed bus board module connections 120.

Figure 32:
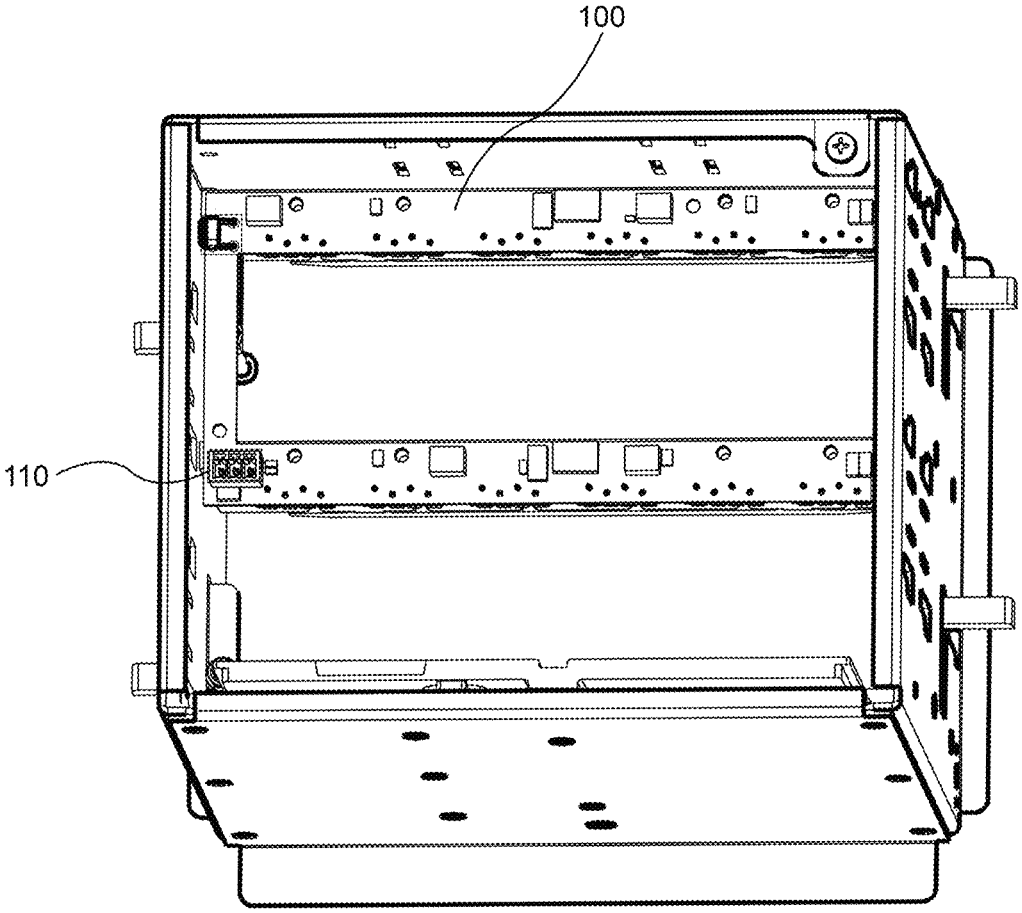
FIG. 32 is a bottom view showing the Bus Board Module Data connection of the Bus Board Assembly as installed within the flip-top in FIG. 1, in accordance with an embodiment of the invention.
Figure 33:
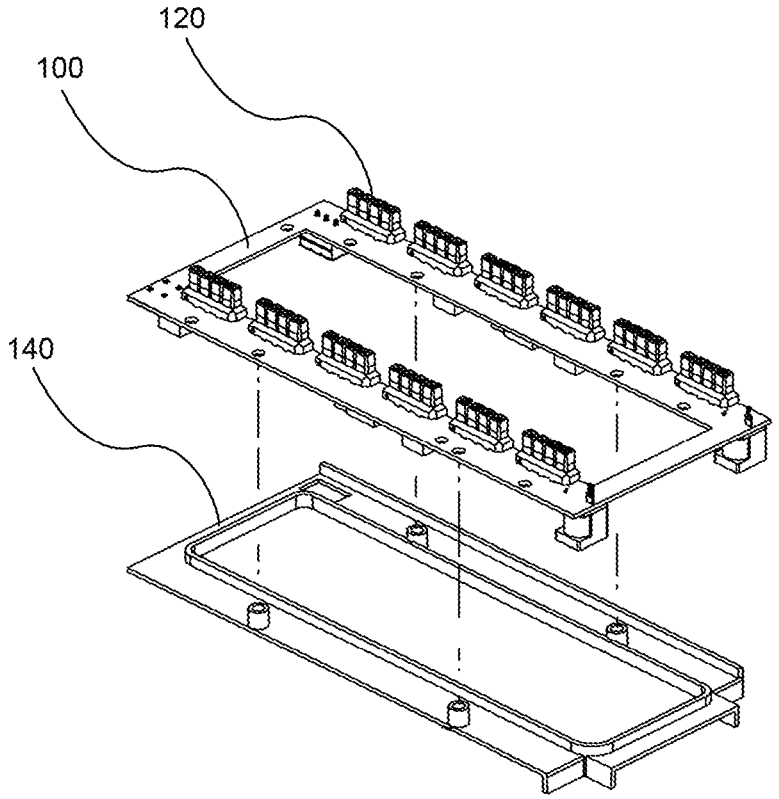
FIG. 33 is a front exploded isometric view showing the Bus Board and Bus Board Cover, in accordance with an embodiment of the invention.
Figure 34:
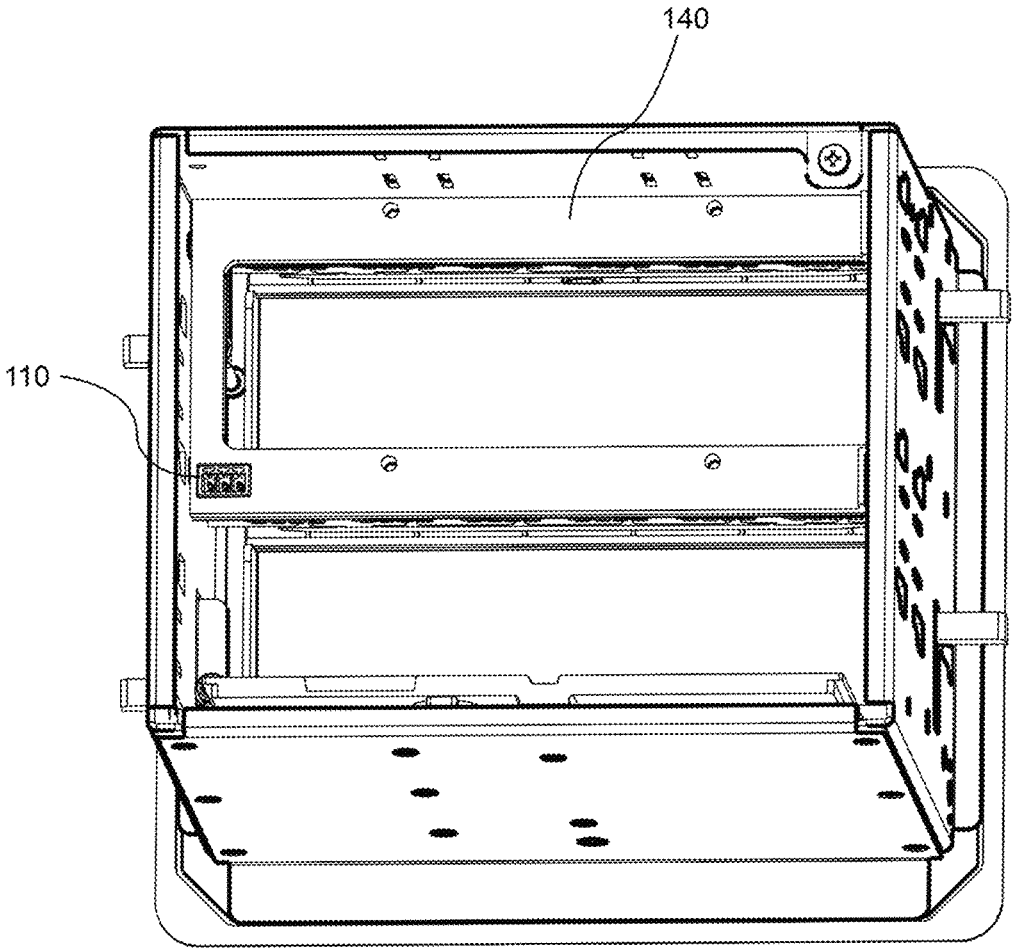
FIG. 34 is a bottom isometric view showing the Bus Board Cover installed over the Bus Board, in accordance with an embodiment of the invention.

As shown in FIG. 32, the bottom of Bus Board Assembly 100, as installed, includes is a bus board data connection 110. In some embodiments, bus board data connection 110 is provided to enable a data controller or control computer to pass bidirectional data to or from any installed module insert. As shown in FIG. 33, some embodiments may include a Bus Board Cover 140. Bus Board Cover 140 may be used to secure Bus Board 100 into the flip-top enclosure as shown in FIG. 34.

Figure 35:
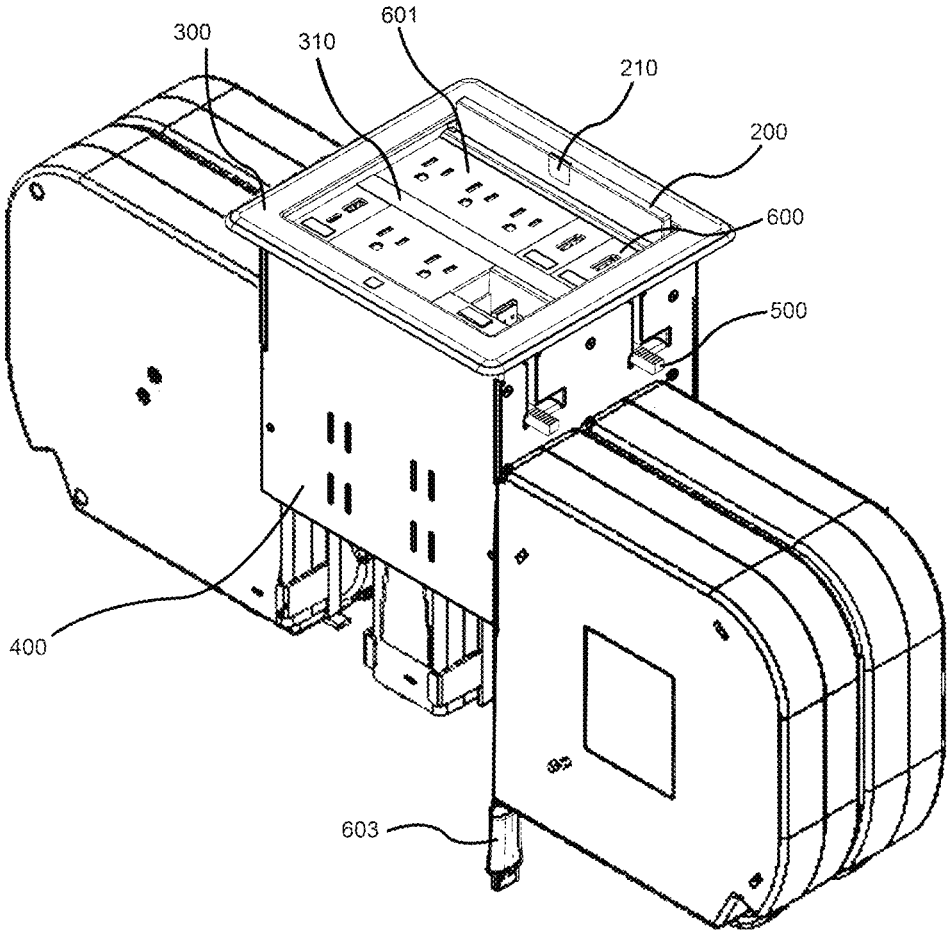
FIG. 35 is a front isometric view of a flip-top fitted with one or more cable retractors in accordance with an alternative embodiment of the invention.

Alternate embodiments may be devised without departing from the spirit or the scope of the invention. For example, an interchangeable module inserts may be configured with any one or more of the connections typically desired in a conference, meeting, or presentation room scenario. Additionally, the disclosed flip-top enclosure may be fitted with one or more cable retractors as shown in FIG. 35.

It should be understood that this description is not intended to limit the embodiments. On the contrary, the embodiments are intended to cover alternatives, modifications, and equivalents, which are included in the spirit and scope of the embodiments as defined by the appended claims. Further, in the detailed description of the embodiments, numerous specific details are set forth to provide a comprehensive understanding of the claimed embodiments. However, one skilled in the art would understand that various embodiments might be practiced without such specific details.

Although the features and elements of aspects of the embodiments are described being in particular combinations, each feature or element can be used alone, without the other features and elements of the embodiments, or in various combinations with or without other features and elements disclosed herein.

The invention claimed is:

1. A modular tabletop enclosure for housing one or more module inserts having a spring-loaded drop-down flip-top lid comprising:

a housing back;

a profile guide rail mounted to said housing back, whereby said profile guide rail provides a vertical channel, a rack gear mounted to said housing back;

a lid assembly comprised of a lid and a lid carrier, wherein said lid is pivotally secured to a lid carrier with a hinge pin positioned through a torsion spring, said torsion spring being tensioned to springably bias said lid to stand parallel with said lid carrier;

a linear guide carriage mounted to said lid carrier for slidably engaging within said vertical channel of said profile guide rail, a rotary damper mounted to rear of said lid carrier to provide linear dampening by rotatably engaging along the length of said rack gear;

a frame secured to said housing back to form an enclosed area;

a module guide having a plurality of module rail groves for mating with a module rail of said one or more module inserts;

a door guide block attached to each top rear surface of said frame for allowing said lid assembly to recess only after it is fully extended and parallel to said lid, and for slidably engaging lid during its recess into said modular tabletop enclosure; and a bezel having a plurality of magnets disposed underneath said bezel for magnetically attaching said bezel to the top of said frame.

2. The modular tabletop enclosure according to claim 1, wherein said module rail groves are shaped to require proper orientation of said module insert in order to mate with said module rail of said module inserts.

3. The modular tabletop enclosure according to claim 1 wherein said module rail is shaped to require proper orientation of said module insert in order to mate with said module rail grooves of said module rails.

4. The modular tabletop enclosure according to claim 1, further comprising a module insert for inserting into said modular tabletop enclosure.

5. The modular tabletop enclosure according to claim 4, further comprising wherein said module insert provides a connection plug receptacle that complies with a specification selected from a group consisting of: Universal Serial Bus (USB) A-Type, USB B-Type, USB C- Type, USB Micro, USB Mini, RS-232, DB-25 F serial port, D-Subminiature (DB)-9, DB-15, DB-25, DB-37, 20-pin Thunderbolt, 24-pin Thunderbolt, 4-pin FireWire (IEEE 1394), 6-pin FireWire (IEEE 1394), 9-pin FireWire (IEEE 1394)

High Definition Multimedia Interface (HDMI), Micro HDMI, Mini HDMI, DisplayPort (DP), Mini DP, Digital Visual Interface (DVI)-A (analog), DVI-D (digital), DVI-I (digital and analog), Embedded DisplayPort (eDP), 4-pin Registered Jack (RJ)-11, 6-pin RJ-12, RJ21, 8-pin RJ-45, 8-pin RJ-48, 5-pin Din (Musical Instrument Digital Interface (MIDI), 4-pin Mini DIN (S-Video), 6-pin Mini DIN (PS/2), 7-pin Mini DIN, 8-pin Mini DIN, NEMA 5-15, NEMA 1-15, IEC 320 C5, IEC 320 C7 (non-polarized), IEC 320 C7 (polarized), IEC 320 C13/C14, IEC 60958 type II (SPDIF), Electronic Industries Association of Japan (EIAJ) optical, XLR Connector (IEC 61076-2-103), Radio Corporation of America (RCA) connector, and TRS Audio.

6. The modular tabletop enclosure according to claim 4, further comprising wherein said module insert includes a Universal Serial Bus (USB) receptacle for providing a Self-powered Dedicated Charging Port receptacle self-powered from a connection to a buss board, said receptacle that complying with at least one version of specification selected from a group of: Universal Serial Bus (USB) Power Delivery Specification, Battery Charging specification revision, and Power Device Class Document.

7. The modular tabletop enclosure according to claim 1 wherein said lid further comprises a first and second side, said first and second side each having a channel extending along the length of said each first and second side of said lid such that a door guide block engages each channel of first and second side while said lid is recessing downwardly in to said tabletop enclosure.

8. The modular tabletop enclosure according to claim 1, wherein said frame further comprises one or more dog-ears, wherein said dog-ears are rotatable between a first position where they lie within the perimeter of said frame such that insertion and removal of said tabletop enclosure permitted, and a second position where they extend outwardly from said frame to secure said tabletop enclosure within an opening cut through a tabletop surface when said frame is recessed through said opening and below said tabletop surface.

9. The modular tabletop enclosure of claim 1, wherein said tabletop surface is horizontal.

10. The modular tabletop enclosure of claim 1, wherein said lid further comprises a steel insert, and said bezel further comprises a lid release button assembly with a lid release button on exposed through the top surface of said bezel, said lid release button assembly further comprising a inwardly protruding lid release button assembly magnet for magnetically capturing said steel insert of said lid, whereby depressing said lid release button causes said lid release button assembly and said lid release button assembly magnet to pitch downwardly and away from said steel insert thereby releasing said lid when said lid release button is depressed.

11. The modular tabletop enclosure of claim 1, wherein said rotary damper provides dampening forces to permit the said lid assembly to recess at a smooth rate of decent into said the flip-top enclosure and said linear guide carriage provides linear guidance for the lid assembly's decent during said recess.

12. The modular tabletop enclosure of claim 11, in whereby when said lid is in the closed position, depressing said lid release button lid automatically, without any additional user intervention, causes said lid to spring open and then autonomously recess by sliding downwardly in a smooth controlled manner into the flip-top enclosure until it is substantially recessed.

13. A tabletop enclosure for recessed installation into a hole cut out from a table work surface, said tabletop enclosure comprising:

a housing back having a profile guide rail and a rack gear are secured to said housing back;

a lid assembly comprising a lid that is pivotally secured to a lid carrier with a hinge pin, a torsion spring concentrically disposed about said hinge pin, said torsion spring being springably tensioned between said lid and said lid carrier, whereby said lid is constantly biased to pivot open parallel to said lid carrier, said lid assembly further comprising a linear guide carriage secured to said lid carrier and rotary damper secured to said lid carrier;

a frame for housing for one or more module inserts, said frame having two or more module guides each having a plurality of module rail groves for receiving a module rail of said one or more module inserts; said frame further comprising a left door guide block and a right door guide block, wherein said left door guide block provides a gliding surface for the left side of lid and said right door guide block provides a gliding surface for the right side of lid, whereby both door guide blocks permit said lid assembly to recess only when said lid is parallel to said lid carrier and thereafter slidably engaging side channels disposed along each side of said lid during recess into said tabletop enclosure; and a bezel comprising a plurality of magnets disposed underneath said bezel for magnetic attachment to the top of said frame, and wherein the top portions of said frame which are adjacent to said plurality of magnets of said bezel, are constructed from a ferromagnetic metal.

14. The modular tabletop enclosure according to claim 13, wherein the width of said module rail groves are varied to require proper insertion orientation of said module insert when mated with said corresponding module rail of said module inserts.

15. The modular tabletop enclosure according to claim 13 wherein said lid further comprises a first and second side, said first and second side each having a channel extending along the length of said each first and second side of said lid such that a door guide block engages each channel of first and second side while said lid is recessing downwardly in to said tabletop enclosure.

16. The modular tabletop enclosure according to claim 13, wherein said frame further comprises one or more dog-ears, wherein said dog-ears are rotatable between a first position where they lie within the perimeter of said frame such that insertion and removal of said tabletop enclosure permitted, and a second position where they extend outwardly from said frame to secure said tabletop enclosure within an opening cut through a tabletop surface when said frame is recessed through said opening and below said tabletop surface.

17. The modular tabletop enclosure of claim 15, wherein said lid further comprises a steel insert, and said bezel further comprises a lid release button assembly with a lid release button on exposed through the top surface of said bezel, said lid release button assembly further comprising a inwardly protruding lid release button assembly magnet for magnetically capturing said steel insert of said lid, whereby depressing said lid release button causes said lid release button assembly and said lid release button assembly magnet to pitch downwardly and away from said steel insert thereby releasing said lid when said lid release button is depressed.

18. The modular tabletop enclosure of claim 15, wherein said rotary damper provides dampening forces to permit the said lid assembly to recess at a smooth rate of decent into said the flip-top enclosure and said linear guide carriage provides linear guidance for the lid assembly's decent during said recess.

* * * * *